US009877563B2

(12) United States Patent
Tweg

(10) Patent No.: US 9,877,563 B2
(45) Date of Patent: Jan. 30, 2018

(54) DEPILATION DEVICE

(71) Applicant: Edward Tweg, Ramle (IL)

(72) Inventor: Edward Tweg, Ramle (IL)

( * ) Notice: Subject to any disclaimer, the term of this patent is extended or adjusted under 35 U.S.C. 154(b) by 214 days.

(21) Appl. No.: 14/354,930

(22) PCT Filed: Nov. 8, 2012

(86) PCT No.: PCT/IL2012/000369
§ 371 (c)(1),
(2) Date: Apr. 29, 2014

(87) PCT Pub. No.: WO2013/069006
PCT Pub. Date: May 16, 2013

(65) Prior Publication Data

US 2014/0316438 A1 Oct. 23, 2014

(51) Int. Cl.
*A61B 17/50* (2006.01)
*A45D 26/00* (2006.01)

(52) U.S. Cl.
CPC ..... *A45D 26/00* (2013.01); *A45D 26/0023* (2013.01); *A45D 26/0028* (2013.01); *A45D 26/0066* (2013.01); *A45D 26/0076* (2013.01)

(58) Field of Classification Search
CPC ..... A45D 26/00; A45D 26/0023; A45D 26/0033; A45D 26/0028; A45D 26/0066; A45D 26/0076
USPC ..... 606/133
See application file for complete search history.

(56) References Cited

U.S. PATENT DOCUMENTS 5,133,722 A 7/1992 Avrahami et al.
6,074,400 A 6/2000 Nuijs et al.

FOREIGN PATENT DOCUMENTS

IE EP 0476185 A1 * 3/1992 ..... A45D 26/0076

* cited by examiner

*Primary Examiner* — Kristen Matter

(57) ABSTRACT

A depilation device operative to tweeze hairs from a narrow, selected area on a skin surface, continuously. Relatively short hairs may be tweezed. Additionally, relatively rapid and painless tweezing is provided. The depilation device is ergonomically designed for easy and effective hair tweezing.

13 Claims, 21 Drawing Sheets

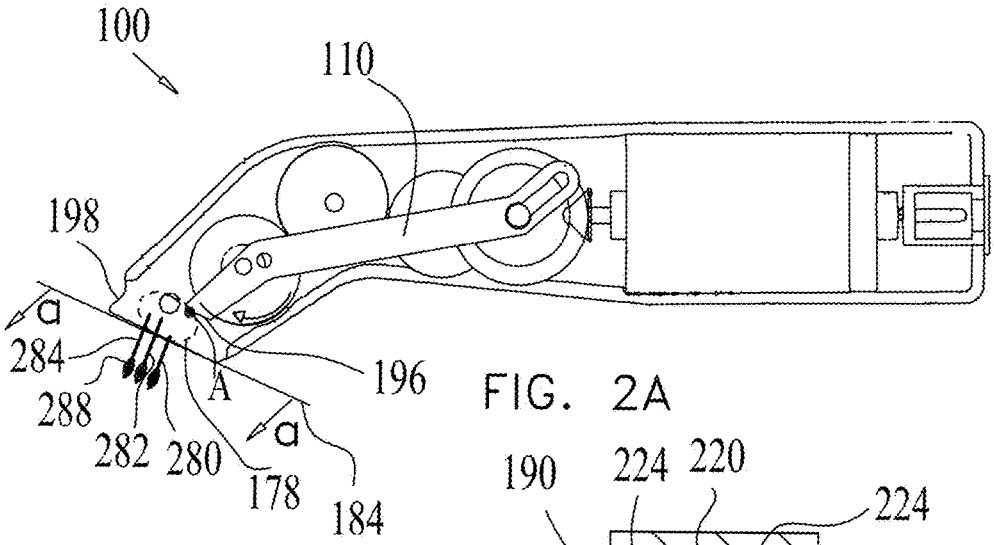
FIG. 2A
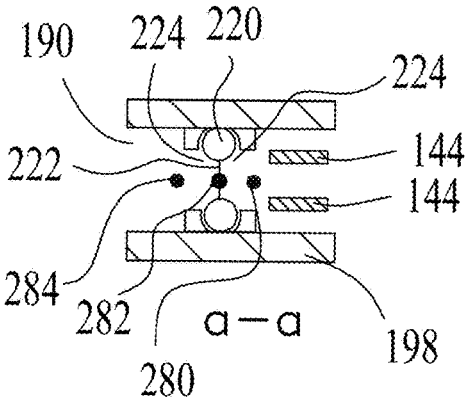
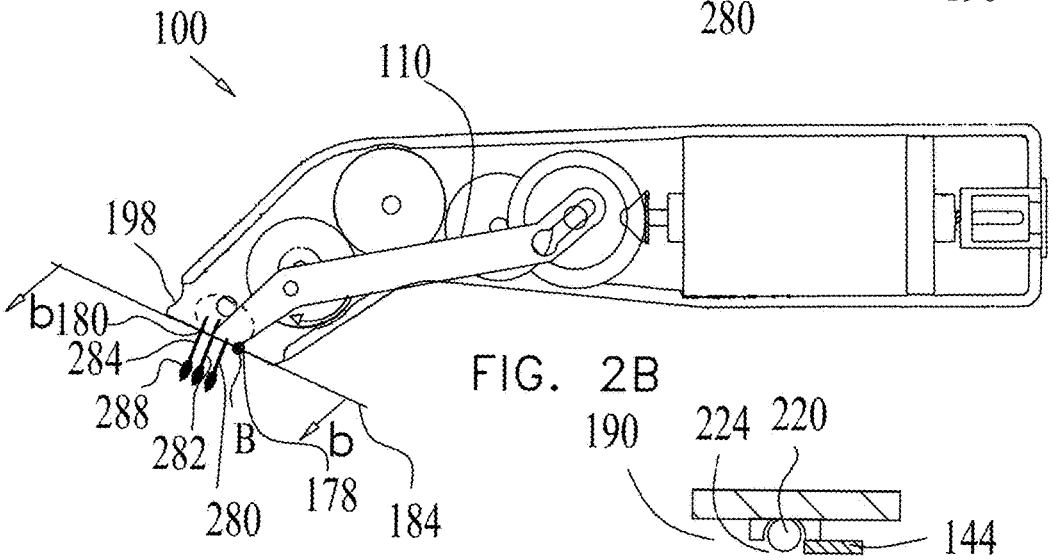
FIG. 2B
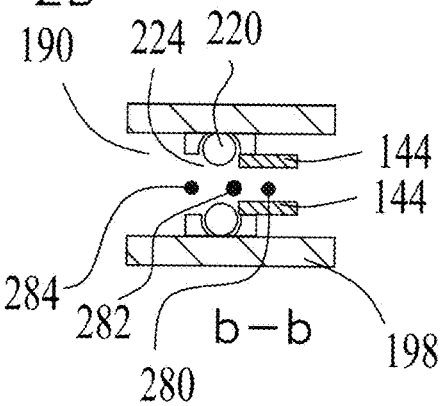

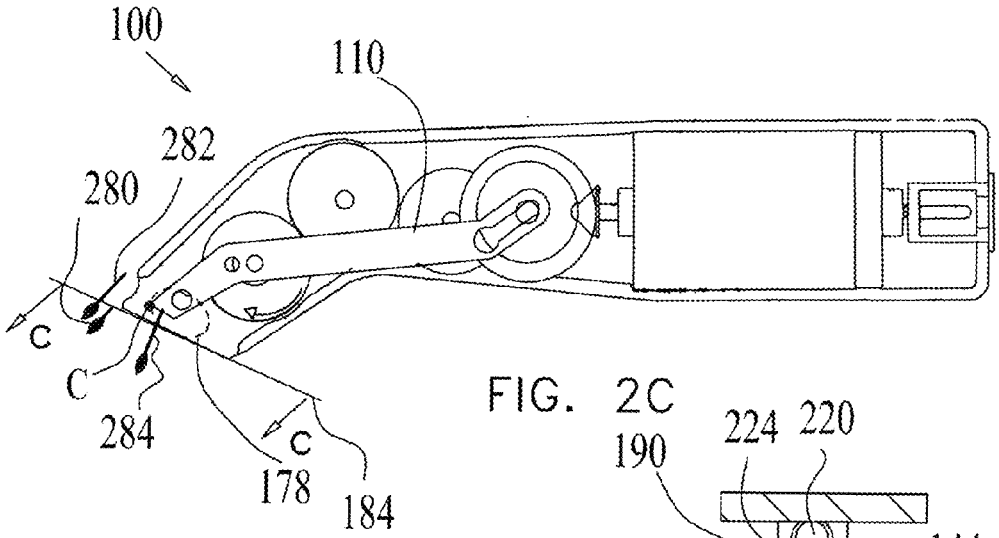
FIG. 2C
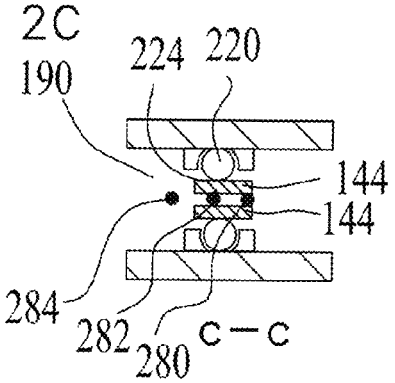
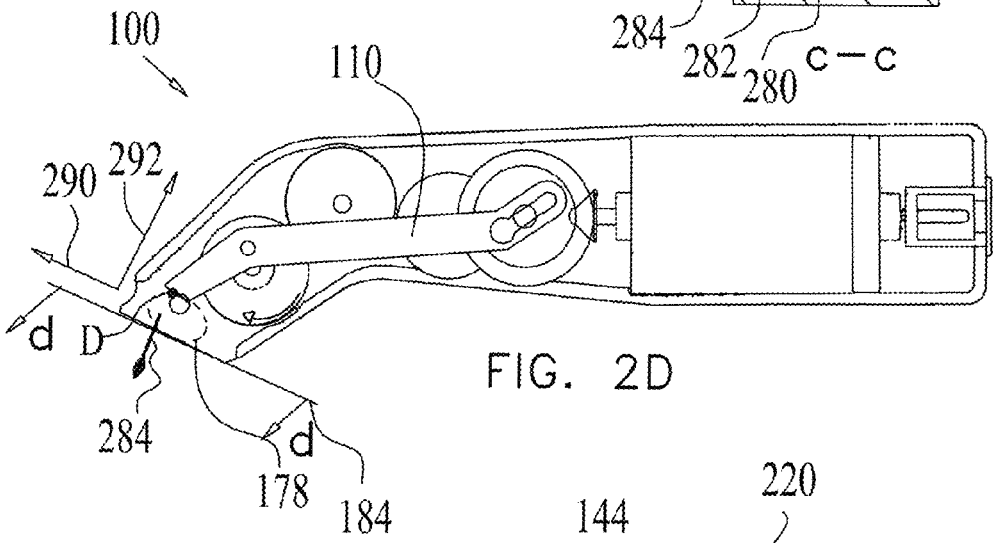
FIG. 2D
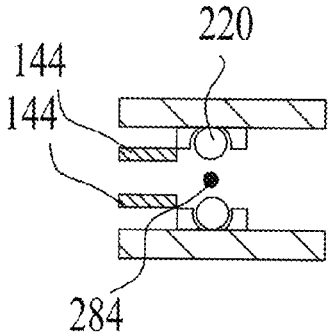
d—d

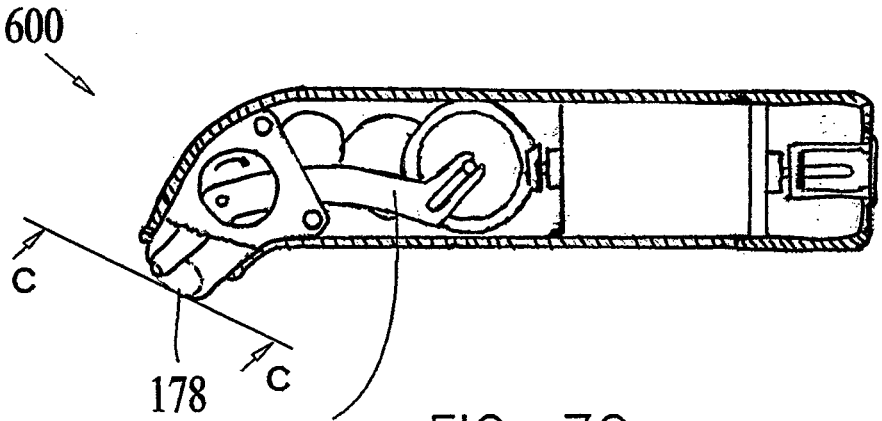
FIG. 7C
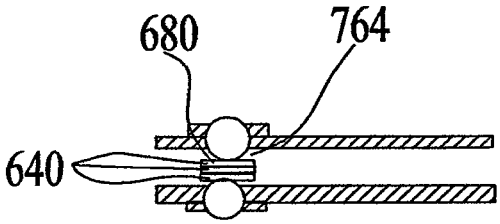
c—c
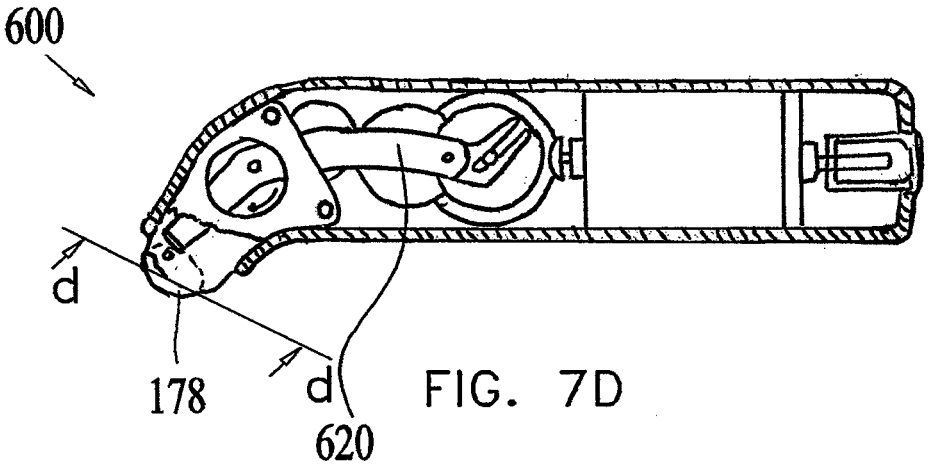
FIG. 7D
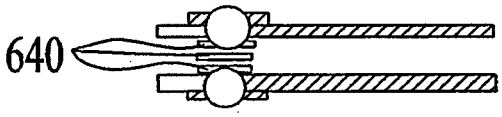
d—d

DEPILATION DEVICE

CROSS REFERENCE TO RELATED APPLICATIONS

This application claims priority to U.S. Provisional Patent Application No. 61/558,926, filed Nov. 11, 2011 and titled "Electric Device for Excess Hair Plucking along a Narrow Track"; and from U.S. Provisional Patent Application No. 61/652,622, filed May 29, 2012 and titled "Electric Device for Excess Hair Plucking along a Narrow Track". The disclosures of the above applications are incorporated herein by reference in their entireties.

FIELD OF THE INVENTION

The present invention relates generally to depilation devices and components thereof.

BACKGROUND OF THE INVENTION

Hairs grow from their roots within the hair follicles deep in the skin dermis. There are devices known in the art for depilation of hairs from the hair follicles which are directed to depilate hairs from a large area of the skin surface, such as the legs, chest or back, for example. There is a need in the art for providing a device for depilation of hairs from a relatively small area of the skin surface, such as facial hair, for example.

SUMMARY OF THE INVENTION

There is thus provided in accordance with an embodiment of the present disclosure a depilation device operative to tweeze hairs from a narrow, selected area on a skin surface, continuously. Relatively short hairs may be tweezed. Additionally relatively rapid and painless tweezing is provided. The depilation device is ergonomically designed for easy and effective hair tweezing.

There is thus provided in accordance with an embodiment of the present disclosure a depilation device for tweezing hairs of a selected area of a skin surface, including a motor, a tweezing element formed with at least two tweezing members, the tweezing element including a tweezing region at an end portion thereof proximal the skin surface, the tweezing region may be a region on the tweezing element that is in contact with the hairs sometime during operation of the depilation device, a transmission assembly for transmitting movement of the motor to the tweezing element, and a depilation enclosure for enclosing at least the tweezing region and including an opening designed to be placed on the selected area. The selected area may be defined by a breadth and length, wherein the breadth is relatively narrow including a skin surface wherein a single or a few hairs grow therefrom. The depilation enclosure may be configured substantially without any components peripheral to the depilation device, which components would disable an operator to view, during operation of the depilation device, an area adjacent to the breadth of the selected area, wherein the adjacent area defines an area enabling sufficient visibility of the depilation enclosure for substantially accurate targeting of the selected area for depilation of the hairs therefrom. The tweezing element may be designed to depilate the hairs while the depilation enclosure is generally continuously in contact with the skin surface, thereby allowing continues depilation along the length of the selected area without necessitating removal of the depilation device above the skin surface.

In accordance with an embodiment, the tweezing element does not pass the opening of the depilation enclosure during operation of the depilation device. Additionally, the tweezing element is formed of more than two tweezing members. Furthermore, the depilation enclosure includes a clamping element provided to clamp together the tweezing members at the tweezing region thereby griping the hairs for depilation thereof.

In accordance with an embodiment, the clamping element is designed for reduced friction thereof and of the tweezing members. Additionally, the clamping element includes balls protruding from the depilation enclosure. Moreover, the clamping element is formed or coated with a material with a relatively low coefficient of friction. Furthermore, the clamping element includes a ball rotating within a socket. Alternatively, the clamping element includes a wheel. Additionally, the wheel is positioned at an incline relative to the depilation enclosure. Furthermore, the clamping element includes a protrusion with an elongated length.

In accordance with an embodiment, a portion of a housing of the depilation device includes the depilation enclosure. Additionally, the depilation enclosure includes two parallel plates. Moreover, the depilation enclosure includes a comb. Accordingly, the comb includes a tooth or a recess.

In accordance with an embodiment, a housing of the depilation device includes a longitudinal portion and a curved portion, which said curved portion includes the depilation enclosure. Alternatively, a housing of the depilation device includes a longitudinal portion and a tapered portion, which said tapered portion includes the depilation enclosure. Additionally, the movement of the tweezing element causes the tweezing region to move in an elliptical path. Moreover, the tweezing element is moved by the transmission assembly in a reciprocal movement and in an eccentric rotation. Furthermore, a lower section of the elliptical path is substantially tangent to the skin surface.

In accordance with an embodiment, the selected area is defined by a breadth and length wherein the breadth is less than approximately 10 mm. Additionally, the transmission assembly includes a supporting shaft for rotating about the motor and for supporting a bracket wherein the tweezing element is inserted in the bracket. Moreover, the tweezing element includes a first longitudinal portion and a second portion curved relative to the first longitudinal portion, the second portion includes the tweezing region.

In accordance with an embodiment, the tweezing member includes a disc. Additionally, the tweezing element includes at least two discs interlocked therebetween so as to mutually engage the discs at an end portion of the tweezing element and defining at the end portion the tweezing region. Moreover, the at least two discs are interlocked therebetween by peripheral teeth formed on a periphery of each of the at least two discs. Alternatively, the at least two discs are interlocked therebetween by central lobes formed at a center of each of the at least two discs.

There is thus provided in accordance with an embodiment a depilation device for tweezing hairs from a skin surface, including a motor, a tweezing element including a tweezing region at an end portion thereof proximal the skin surface, the tweezing region defining a region on the tweezing element that is in contact with the hairs sometime during operation of the depilation device, and a transmission assembly for transmitting movement of the motor to the tweezing element and moving the tweezing region in a substantially elliptical path.

There is thus provided in accordance with an embodiment a method for tweezing hairs of a selected area of a skin surface, comprising providing a depilation device, said depilation device including a motor, a tweezing element formed with at least two tweezing members, the tweezing element comprising a tweezing region at an end portion thereof proximal to the skin surface, the tweezing region defining a region on the tweezing element that is in contact with the hairs sometime during operation of the depilation device, a transmission assembly for transmitting movement of the motor to the tweezing element, and a depilation enclosure for enclosing at least the tweezing region and comprising an opening designed to be placed on the selected area, placing the opening of the depilation enclosure on the selected area, the selected area being defined by a breadth and length, wherein the breadth is relatively narrow comprising a skin surface wherein a single or a few hairs grow therefrom, transmitting movement of the motor to the tweezing element via the transmission assembly for depilation of the hairs by the tweezing element, and allowing an operator to view, during operation of the depilation device, an area adjacent to the breadth of the selected area, wherein the adjacent area defines an area enabling sufficient visibility of the depilation enclosure for substantially accurate targeting of the selected area for depilation of the hairs therefrom.

The depletion device may comprise an incomplex structure lending to a reliable and low manufacturing cost device.

BRIEF DESCRIPTION OF THE DRAWING

The present subject matter will be understood and appreciated more fully from the following detailed description, taken in conjunction with the drawings in which:

FIGS. 2A-2D are simplified operational illustrations and sectional illustrations of the depilation device of FIGS. 1A and 1B at a first, second, third and fourth operational stage, respectively;

FIGS. 7A-7D are simplified operational illustrations and sectional illustrations of the depilation device of FIGS. 5A-6D at a first, second, third and fourth operational stage, respectively;

DETAILED DESCRIPTION OF EMBODIMENTS

In the following description, various aspects of the present subject matter will be described. For purposes of explanation, specific configurations and details are set forth in order to provide a thorough understanding of the present subject matter. However, it will also be apparent to one skilled in the art that the present subject matter may be practiced without specific details presented herein without departing from the scope of the present invention. Furthermore, the description omits and/or simplifies some well known features in order not to obscure the description of the subject matter.

Figure 1A:
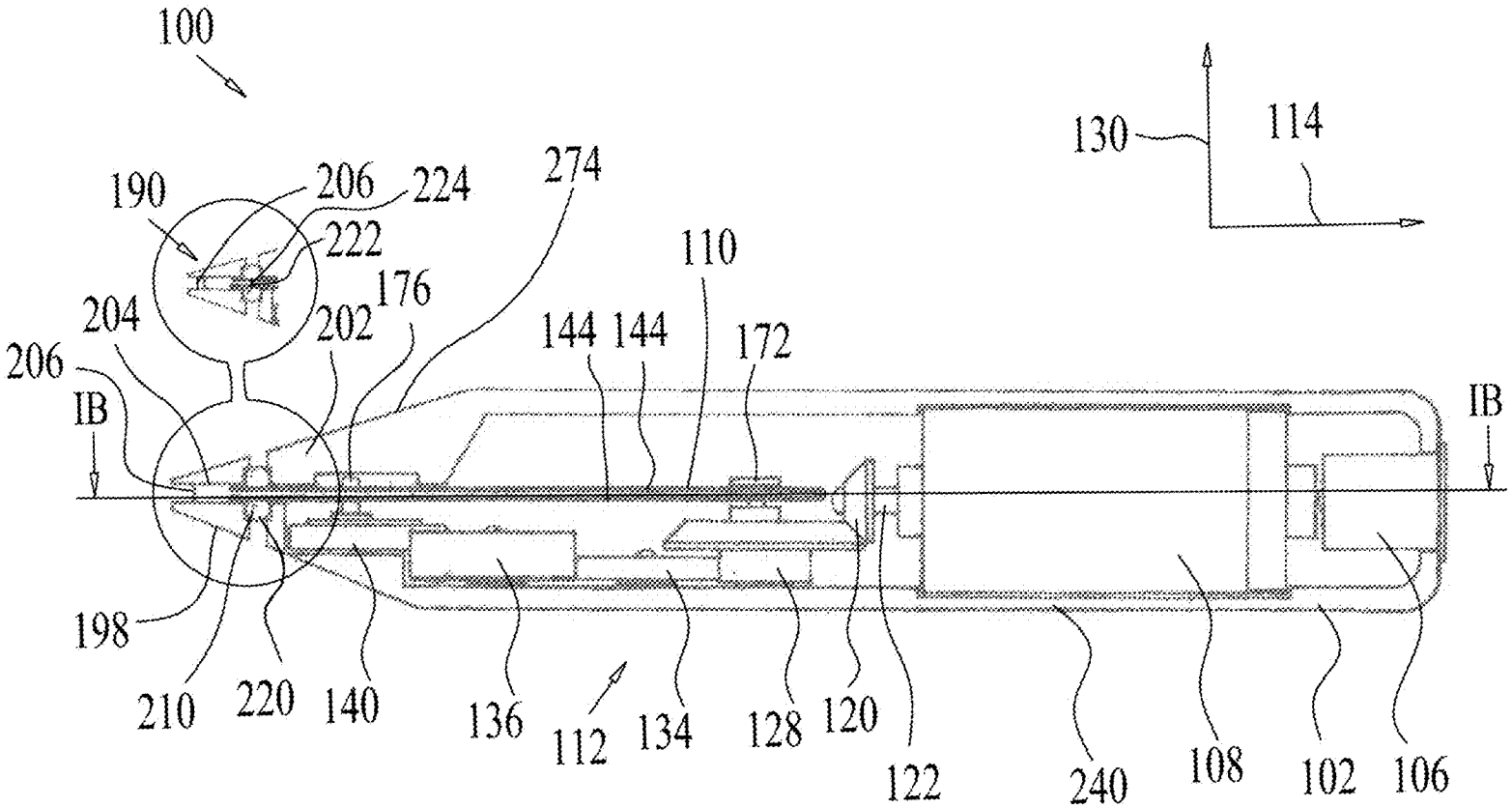
FIGS. 1A and 1B are a simplified sectional illustration of a depilation device, constructed and operative in accordance with an embodiment of the present invention, and a simplified sectional illustration taken along lines IB-IB of FIG. 1A, respectively.
Figure 1B:
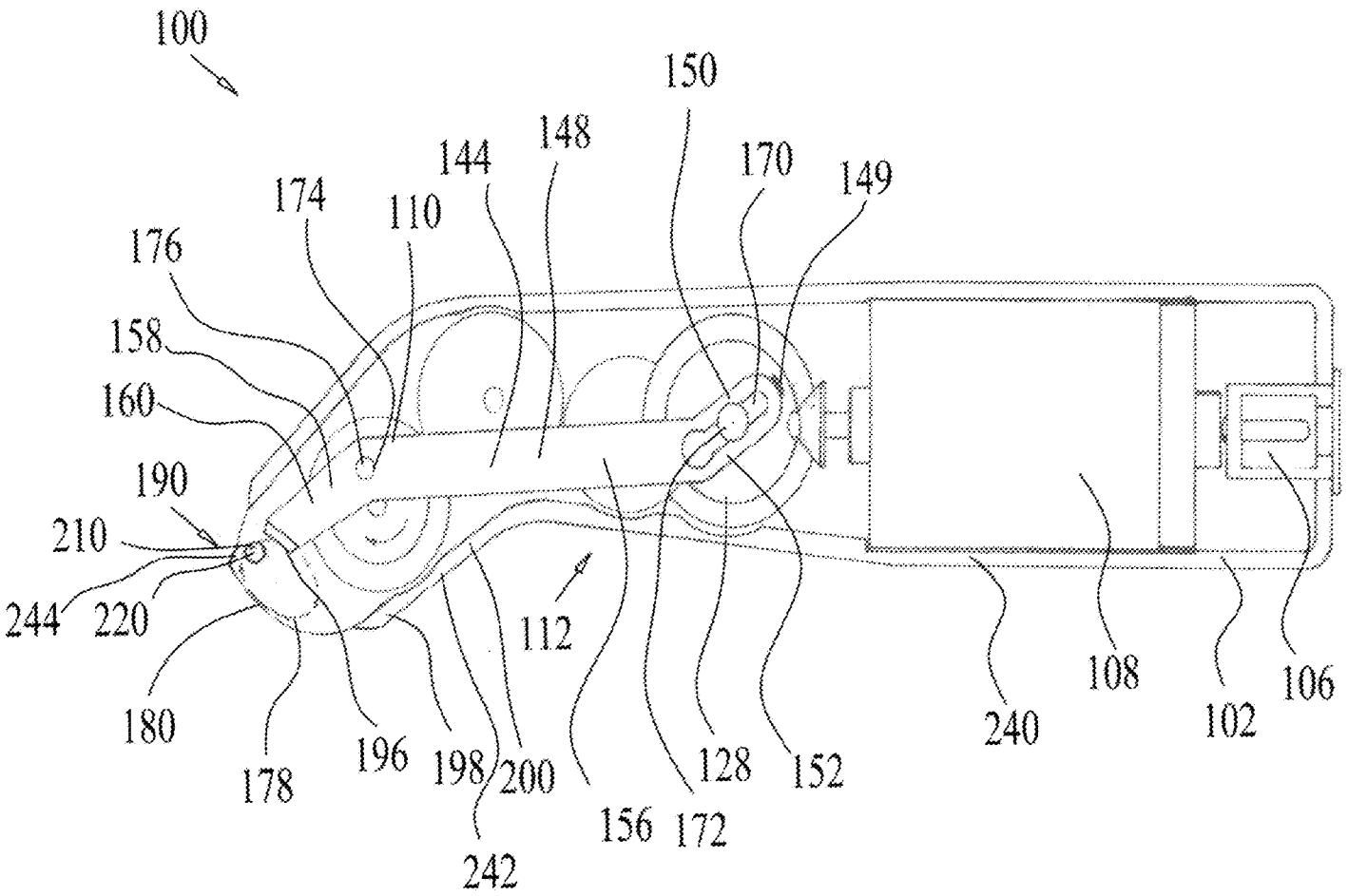

Reference is now made to FIGS. 1A and 1B, which are a simplified sectional illustration of a depilation device, constructed and operative in accordance with an embodiment of the present invention, and a simplified sectional illustration taken along lines IB-IB of FIG. 1A, respectively. As seen in FIG. 1A, a depilation device 100 comprises a housing 102. A socket 106, connected via an outlet to a power supply, is provided to activate a motor 108. Alternatively, the power supply may be provided by batteries or any other suitable means. The socket 106 may be designed with appropriate attachments allowing the batteries to be recharged.

The motor 108 is provided to move a tweezing element 110 via a transmission assembly 112. The motor 108 rotates about a longitudinal axis 114. The transmission assembly 112 may comprise a first gear 120, such as a bevel gear, inserted on a drive shaft 122 protruding from the motor 108. The first gear 120 rotates about the longitudinal axis 114. The first gear 120 contacts a second gear 128 thereby translating the first gear 120 rotation about longitudinal axis 114 to rotate about a vertical axis 130. The rotation of second gear 128 is transmitted via a third gear 134 and a fourth gear 136 to a fifth gear 140. The transmission assembly 112 may be designed with any suitable number of gears for transmitting movement from the motor 108 to the tweezing element 110.

It is appreciated that the transmission assembly 112 may comprise any suitable configuration for transmitting movement from the motor 108 to the tweezing element 110. Exemplary alternative transmission assemblies will be further described in reference to FIGS. 4A-4B.

The tweezing element 110 may be configured in any suitable configuration. The tweezing element 110 generally may be formed with at least two mutually facing tweezing members 144. In the embodiments shown in FIGS. 1A-2E the tweezing element 110 may be formed of two tweezing members 144 comprising levers 148. The tweezing members 144 may be engaged therebetween in any suitable manner, such as via a rivet or bracket 149. It is appreciated that additional tweezing members 144 may be provided, such as will be further described in reference to FIGS. 5A-8F.

The tweezing element 110 may comprise a first section 150 at a first end portion 152 thereof.

The tweezing element 110 may comprise an intermediate, second section 156 which connects the first section to a third section 158 at a second end portion 160 of the tweezing element 110. The tweezing element 110 may be shaped in any suitable manner to fit within the housing 102. As seen in FIG. 1B, the first section 150 may be upwardly inclined relative to the second section 156 and the third section 158 may be downwardly inclined relative to the second section 156.

The first section 150 may be formed with an elongated slot 170. The elongated slot 170 is provided for mounting the tweezing element 110 at the first end portion 152 thereof on the second gear 128, via a central spindle 172, protruding from the second gear 128. The third section 158 may be formed with an aperture 174 for inserting therein an eccentric spindle 176 protruding from the fifth gear 140. The aperture 174 is for mounting the tweezing element 110 in proximity to the second end portion 160 thereof on the fifth gear 140.

Upon rotation of the motor 108 and first gear 120 about longitudinal axis 114, the respective second, third, fourth and fifth gears 128, 134, 136 and 140 rotate about the vertical axis 130. In turn, the first section 150 of tweezing element 110 reciprocally slides within slot 170. The third section 158 eccentrically rotates with the eccentric spindle 176. This reciprocal movement and eccentric rotation of the respective first section 150 and third section 158 causes the third section 158 of the tweezing element 110 to elliptically rotate forming a substantially elliptical path 178 shown in FIG. 1B.

The elliptical path 178 defines a lower section 180 thereof, which may be substantially tangent to a skin surface 184 (FIGS. 2A-2D), thus defining the elliptical path 178 as comprising an oval-like shape, at least at the bottom portion 180 thereof, with a nearly flat surface. The elliptical paths 178 (one is shown) being on distinct planes from each other. The tangency of the tweezing element 110 with the skin surface 184 is mainly due to the downward incline of third section 158.

In accordance with some embodiments all the depilation devices described in reference to FIGS. 1A-8F may elliptically rotate forming the substantially elliptical path 178.

It is appreciated that the elliptical rotation of the tweezing element 110 may be caused by other forms of movements, besides the reciprocal movement and eccentric rotation thereof. It is further appreciated that the tangency of the tweezing element 110 with the skin may be caused by other types of movement besides the elliptical rotation.

The tweezing element 110 defines a tweezing region 190 at the second end portion 160 thereof, which is proximal to the skin surface 184. The tweezing region may be defined as a region on the tweezing element 110 that is generally in contact with the hairs sometime during operation of the depilation device 100.

An edge 196 of the tweezing element 110 at second end 160 may comprise any suitable breadth. In a non-limiting example the breadth may be in the range of approximately 2-10 mm. Additionally, in a non-limiting example the breadth of edge 196 may be in the range of approximately 2-8 mm. Additionally, in a non-limiting example the breadth of edge 196 may be in the range of approximately 2-6 mm. Additionally, in a non-limiting example the breadth of edge 196 may be in the range of approximately 2-4 mm. Additionally, in a non-limiting example the breadth of edge 196 may be in the range of less than 2 mm.

A depilation enclosure 198 is designed to enclose the tweezing region 190. The depilation enclosure 198 may be formed in any suitable manner. As seen in FIGS. 1A and 1B, an end portion 200 of the housing 102 comprises the depilation enclosure 198.

The depilation enclosure 198 may comprise walls 202 with an interior surface 204 spaced apart by a gap 206. The gap 206 may comprise any suitable breadth. In a non-limiting example the gap 206 may be in the range of approximately 2-10 mm. Additionally, in a non-limiting example the breadth of gap 206 may be in the range of approximately 2-8 mm. Additionally, in a non-limiting example the breadth of gap 206 may be in the range of approximately 2-6 mm. Additionally, in a non-limiting example the breadth of gap 206 may be in the range of approximately 2-4 mm. Additionally, in a non-limiting example the breadth of gap 206 may be in the range of less than 2 mm.

Clamping elements 210 may protrude from the walls 202 of depilation enclosure 198, towards the tweezing region 190. The clamping elements 210 may be formed in any suitable manner for clamping the tweezing members 144 together. As seen in FIGS. 1A and 1B the clamping elements 210 may comprise two oppositely facing balls 220 protruding from the depilation enclosure 198. The clamping elements 210 may comprise a single ball or a plurality of balls or any other suitable shape.

The balls 220 form theretween a gap 222 defining a clamping region 224. As the tweezing region 190 of the tweezing members 144 passes through the clamping region 224, the balls 220 press thereupon, thus forcing the tweezing members 144 to clamp together.

The clamping elements 210 may be designed for reduced friction thereof and of the tweezing members 144, which friction is due to cyclic passage of the tweezing members 144 through the clamping region 224. In a non-limiting example, balls 220 may be formed or coated with a material with a relatively low coefficient of friction, such as nylon which comprises a static coefficient of friction in the range of 0.15-0.25.

The clamping elements 210 may be formed of slidable or rotatable elements for reducing friction, such as will be further described in reference to FIGS. 5A-8F.

The depilation device 100 may be shaped in any suitable manner. In accordance with an embodiment, the housing 102 may be a hand-held device ergonomically formed with a longitudinal gripping portion 240 and a curved portion 242 curving towards the skin surface 184 (FIGS. 2A-2D). Thus an operator of the depilation device 100 may comfortably grip the depilation device 100 at the gripping portion 240. The curved portion 242 may be placed on the skin surface 184 for direct contact therewith.

At the end portion 200 of the depilation enclosure 198 (and housing 102) may be formed a recess 244 provided for combing hairs on the skin surface 184 so as to insert the hairs in gap 206 of the depilation enclosure 198. It is appreciated that the comb may be formed in any suitable manner, as will be further described in reference to FIGS. 6A-6D.

Figure 1C:
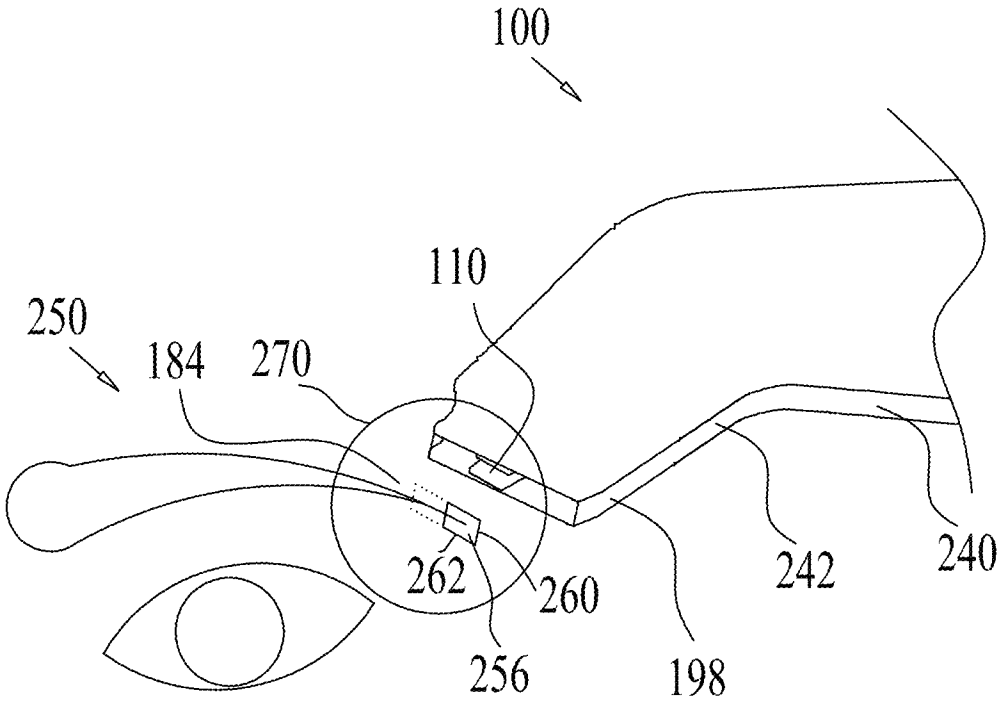
FIG. 1C is a simplified pictorial illustration of the employment of the depilation device of FIGS. 1A and 1B.

Reference is now made to FIG. 1C, which is a simplified pictorial illustration of the employment of the depilation device 100 by an operator 250. During operation, the operator 250 may place the depilation enclosure 198 on a selected area 256 of the skin surface 184 for tweezing hairs therefrom. The selected area is defined by a breadth 260 and length 262. The breadth 260 may be relatively narrow comprising the skin surface 184 wherein a single or a few hairs grow therefrom.

The breadth of gap 206 may be sized to correspond to breadth 260 of the selected area 256. This is for enabling relatively precise depilation of the hairs growing in the selected area 256, without inadvertent depilation of the hairs growing around the selected area 256, in an adjacent, peripheral area 270.

In accordance with an embodiment, walls 274 of the curved portion 222 and particularly the walls 202 of the depilation enclosure 198, may be configured without any additional components peripheral to the depilation device 100. Thus the operator 250 may view the operation of the depilation device 100, since there are no components overlaying the adjacent area 270 which would disable the operator 250 to view the adjacent area 270. The adjacent area 270 may be defined as the area adjacent and peripheral to the selected area 256 that provides the operator 250 sufficient visibility, typically in a mirror, for substantially accurate targeting of the selected area 256 for depilation of the hairs therefrom. As seen in FIG. 1A, walls 274 of the curved portion 222 which include the walls 202 of the depilation enclosure 198, are designed to taper down to substantially the breadth of gap 206 and thus ensure that there are no components of the depilation device 100 overlaying the adjacent area 270.

Additionally, the curved portion 242, which is placed on the skin surface 184, is at an incline from the gripping portion 240 for ensuring that the operator's hand will not overlay the adjacent area 270 during operation.

It is appreciated that walls 274 of the curved portion 222 or the walls 202 of the depilation enclosure 198 may be configured in any suitable manner such as parallel walls, for example.

Reference is now made to FIGS. 2A-2D, which are simplified operational illustrations of the depilation device of FIGS. 1A and 1B, shown in the orientation of FIG. 1B. As seen in FIG. 2A, at a first operational stage, an operator places the depilation device 100 on the skin surface 184. The tweezing element 110 is shown at point A of the substantially elliptical path 178. As seen in the sectional illustration taken along lines a-a in FIG. 2A, the tweezing members 144 are unclamped and away from gap 222. Hairs 280, 282 and 284 grow from the follicles 288 and protrude from the skin surface 184.

Turning to FIG. 2B at a second operational stage, the tweezing element 110 is shown at point B of the substantially elliptical path 178. As seen in the sectional illustration taken along lines b-b in FIG. 2B, the tweezing members 144 remain unclamped and may touch or nearly touch the skin surface 184. Thus hairs 280 and 282 ingress in between the tweezing members 144, at the tweezing region 190.

As described hereinabove, the lower section 180 of the elliptical path 178 may be substantially tangent to the skin surface 184, thus maximizing the contact of the edge 196 with the skin surface 184. Thus relatively short hairs, such as hair 280, may ingress in between the tweezing members 144.

As seen in FIG. 2C, at a third operational stage, the tweezing element 110 is shown at point C of the substantially elliptical path 178. As seen in the sectional illustration taken along lines c-c in FIG. 2C, the tweezing members 144 pass through the clamping region 224 formed intermediate the two balls 220. The two balls 220 force the tweezing members 144 to clamp to each other for tightly gripping hairs 280 and 282 at the tweezing region 190. Subsequently, the hairs 280 and 282 are plucked from their follicles 288, as the tweezing element 110 progresses from point B to C along path elliptical path 178 thereby pulling away from the skin surface 184.

Turning to FIG. 2D, at a fourth operational stage, the tweezing element 110 is shown at point D of the substantially elliptical path 178. As seen in the sectional illustration taken along lines d-d in FIG. 2D, the tweezing members 144 egress the clamping region 224. The tweezing members 144 unclamp, thereby releasing the hairs 280 and 282. The hairs 280 and 282 generally egress the depilation device 100.

Following removal of hairs 280 and 282, the operator may advance the depilation device 100 along the skin surface 184 (as shown by the dotted area in FIG. 1C) in the orientation of arrow 290 so as to commence the operational stages 2A-2D for removal of further hairs, such as hair 284, without removal of the depilation device 100 from above the skin surface 184, in the orientation of an arrow 292. The arrow 292 is in a transverse orientation to arrow 290 and is perpendicular to the surface of the skin surface 184.

In a non-limiting example, the Revolutions Per Minute (RPM) of the tweezing element 110 may be approximately 25.

It is thus seen from FIGS. 1A-2D and as will be described in reference to FIGS. 3A-11, the depilation device 100 enables plucking hairs from a relatively small selected area by placing the depilation device 100 on the skin surface 184 wherein undesired hairs grow. Thus the depilation device 100 may be suitable for removal of undesired hairs from relatively small areas on the skin surface wherein precise removal of specific undesired hair is required. This selected area may include the bikini line and facial hair, such as the mustache area and eyebrow area, for example.

The depilation device 100 is designed to be placed on the skin surface 184. The operator may advance the depilation device 100 along the skin surface 184 while continuously contacting the skin surface 184 during operation, without requiring raising the depilation device 100 above the skin surface 184. Thus the depilation device 100 enables continues removal of undesired hairs along a narrow yet elongated area, as described in reference to FIG. 2D.

Additionally, the tweezing element 110 may grip a few hairs at a single operational stage, such as hairs 280 and 282. Thus the depilation device 100 provides relatively rapid removal of undesired hairs.

Moreover the tight gripping the hairs by the tweezing element 110 and plucking thereof ensures substantially painless and effective removal of the hairs along with their roots from the hair follicles.

Furthermore, the tweezing of the hairs may be performed by initially placing the depilation enclosure 198 on the skin surface 184, thereby slightly pressing thereupon. Slightly pressing the skin surface 184 prevents pulling of the skin surface 184 by the tweezing region 190, thus substantially painlessly and rapidly tweezing the hairs.

Figure 3A:
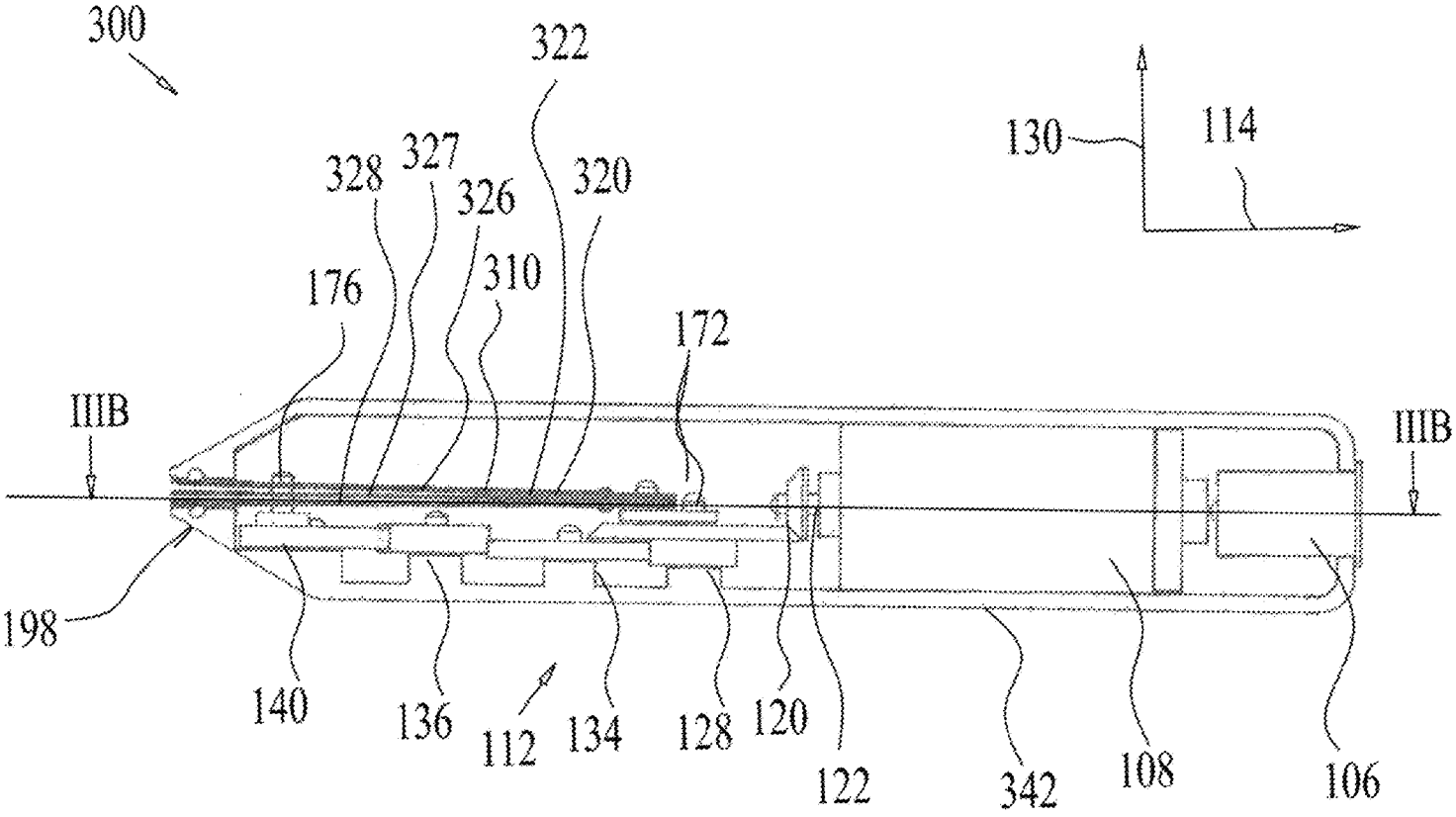
FIGS. 3A and 3B are a simplified sectional illustration of a depilation device, constructed and operative in accordance with another embodiment of the present invention, and a simplified sectional illustration taken along lines IIIB-IIIB of FIG. 3A, respectively.
Figure 3B:
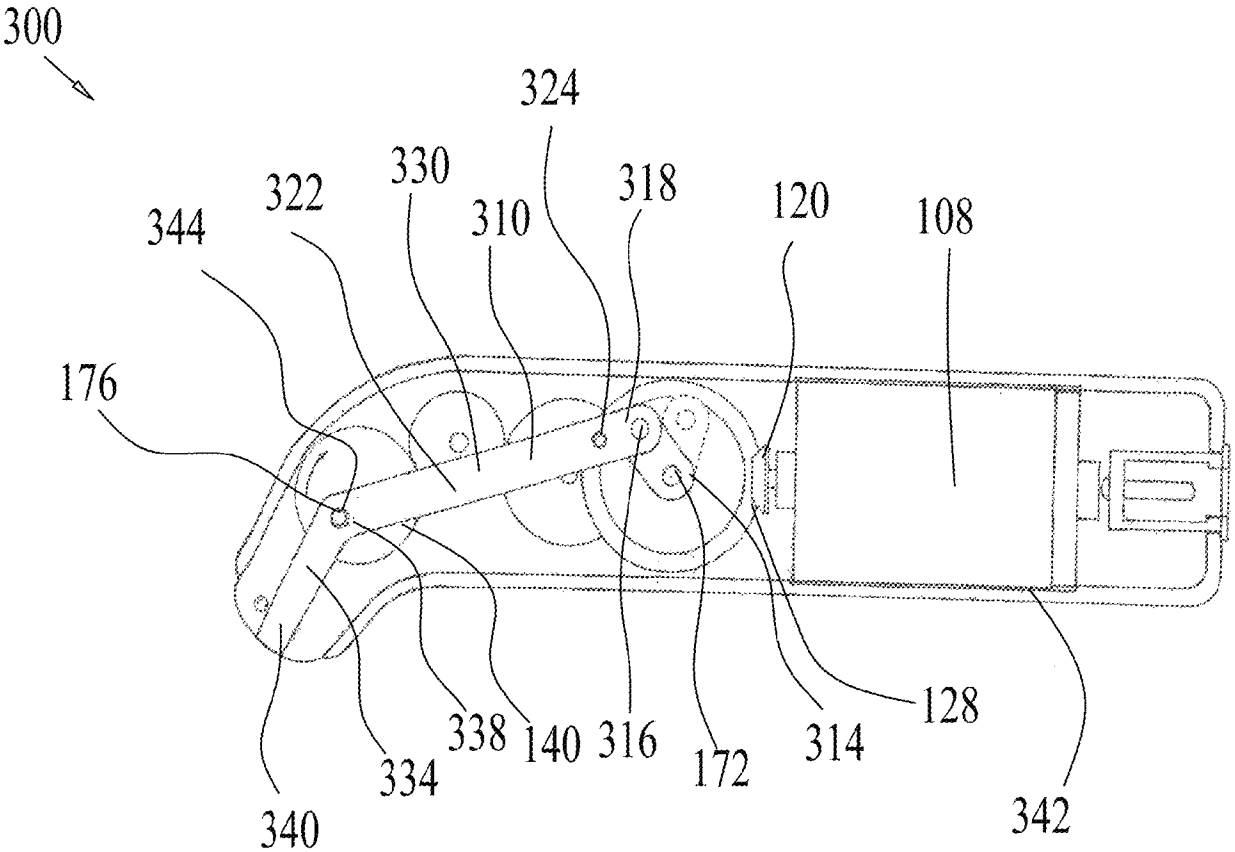

Reference is now made to FIGS. 3A and 3B, which are a simplified sectional illustration of a depilation device, constructed and operative in accordance with another embodiment of the present invention, and a simplified sectional illustration taken along lines IIIB-IIIB of FIG. 3A, respectively. The depilation device 300 shown in FIGS. 3A and 3B is substantially similar to the depilation device 100 of FIGS. 1A-2D, yet comprising an alternative tweezing element 310 and some additional structural differences, which will be described.

The tweezing element 310 may be mounted on a pivoting arm 314 via a joining pin 316 at a first end portion 318 of the tweezing element 310. The pivoting arm 314 may be fixed to the second gear 128 via the central spindle 172.

The tweezing element 310 may be configured in any suitable configuration. In the embodiments shown in FIGS. 3A and 3B, the tweezing element 310 may be formed of three tweezing members 320 each comprising a lever 322. The tweezing members 320 may be engaged therebetween in any suitable manner, such as by a through going pin 324.

Forming the tweezing element 310 with a plurality of tweezing members 320 allows more hairs to ingress in between each two adjacent tweezing members, such as tweezing members 326 and 327 or adjacent tweezing members 327 and 328.

The tweezing element 310 may comprise a first, longitudinal section 330 extending from the first end portion 318 of the tweezing element 310 to a second, inclined portion 334, at an adjoining region 338. The second, inclined portion 334 may be downwardly inclined and extends from the first, longitudinal section 330 to a second end portion 340 of the tweezing element 310.

The tweezing element 310 may be shaped in any suitable manner to fit within a housing 342 of the depilation device 300.

At the adjoining region 338 is an aperture 344 inserted on the eccentric spindle 176 protruding from the fifth gear 140, thereby mounting the tweezing element 310 in proximity to the second end portion 340 thereof on the fifth gear 140.

Upon rotation of the motor 108 and first gear 120 about longitudinal axis 114 the respective second, third, fourth and fifth gears 128, 134, 136 and 140 rotate about the vertical axis 130. In turn, the pivoting arm 314 pivots about central spindle 172, as shown by the dashed lines, causing the tweezing element 310 to reciprocally move. The tweezing element 310 at the adjoining region 338 eccentrically rotates with the eccentric spindle 176. This reciprocal movement and eccentric rotation of the tweezing element 310 causes tweezing element 310 to elliptically rotate, thereby forming the substantially elliptical path 178 shown in FIG. 1B. The elliptical path 178 defines the lower section 180 thereof, which may be substantially tangent to a skin surface 184 (FIGS. 2A-2E), as been described hereinabove.

The operation of the depilation device 300 is substantially similar to the operation of the depilation device 100, as described herein above in reference to FIGS. 1A-2D, mutatis mutandis.

The depilation device 300 may be shaped in any suitable manner. In accordance with an embodiment, the housing 342 substantially similar to the housing 102 of the depilation device 100, as described herein above in reference to FIGS. 1A-2D, mutatis mutandis.

Figure 4A:
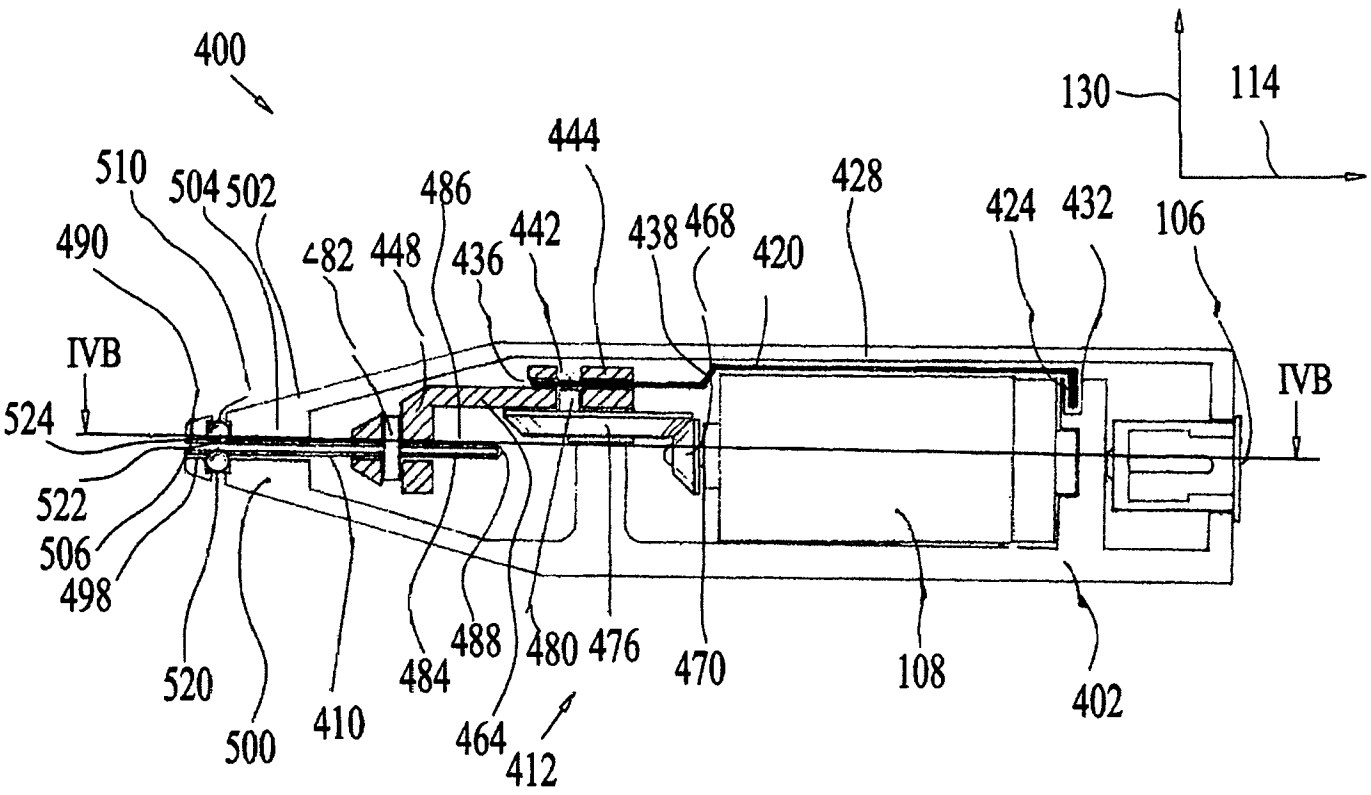
FIGS. 4A and 4B are a simplified sectional illustration of a depilation device, constructed and operative in accordance with another embodiment of the present invention, and a simplified sectional illustration taken along lines IVB-IVB of FIG. 4A, respectively.
Figure 4B:
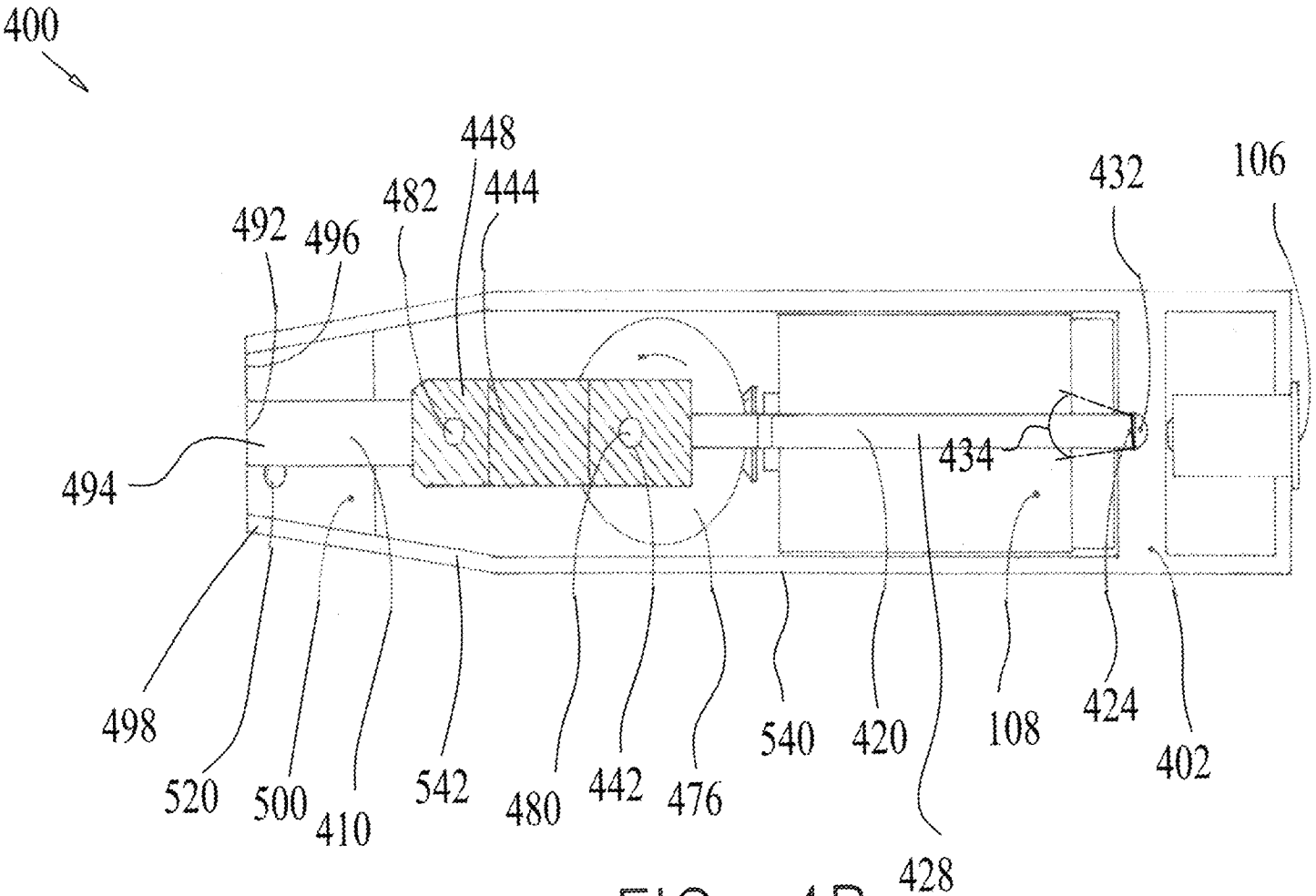

Reference is now made to FIGS. 4A and 4B, which are a simplified sectional illustration of a depilation device, constructed and operative in accordance with another embodiment of the present invention, and a simplified sectional illustration taken along lines IVB-IVB of FIG. 4A, respectively. As seen in FIG. 4A, a depilation device 400 comprises a housing 402. The socket 106, connected via an outlet to a power supply, is provided to activate the motor 108. Alternatively, the power supply may be provided by batteries. The motor 108 is provided to move a tweezing element 410, via a transmission assembly 412. The motor 108 rotates about the longitudinal axis 114.

The transmission assembly 412 may comprise a supporting shaft 420 extending along the motor 108. The supporting shaft 420 may comprise an extension 424 downwardly extending from a longitudinal portion 428 of the supporting shaft 420. The extension 424 is inserted within a cavity 432 formed within the housing 402. The cavity 432 is provided to allow the extension 424 to rotate therein, thereby angularly rotating the longitudinal portion 428 in the orientation of an arrow 434 shown in FIG. 4B and as shown by the dashed lines.

The supporting shaft 420 may be formed in any suitable configuration.

The supporting shaft 420 may comprise a shaft support portion 436 connected to the longitudinal portion 428 by an inclined portion 438. The shaft support portion 436 is inserted within a first, protruding portion 442 of a bracket 444. A third, tweezing element support portion 448 of the bracket 444 supports the tweezing element 410. An intermediate portion 464 connects the first, protruding portion 442 to the third, tweezing element support portion 448.

The transmission assembly 412 may further comprise a first gear 468, such as a bevel gear, inserted on a drive shaft 470 protruding from the motor 108. The first gear 468 rotates about the longitudinal axis 114. The first gear 468 contacts a second gear 476, thereby translating the first gear 468 rotation about longitudinal axis 114 to rotation about the vertical axis 130.

The first, protruding portion 442 is mounted on the second gear 476, via an eccentric spindle 480. The tweezing element 410 is supported by the third, tweezing element support portion 448 and is secured thereto by a pin 482 or any other suitable means.

The tweezing element 410 may comprise a plurality of tweezing members 484 and is shown here to comprise two generally uncurved levers 486. The tweezing members 484 may be engaged therebetween in any suitable manner, such as via a rivet or bracket 488.

Upon rotation of the motor 108 and first gear 468 about longitudinal axis 114 the second gear 476 rotates about the vertical axis 130. In turn, the tweezing element 410 eccentrically rotates with the eccentric spindle 480. The extension 424 of the supporting shaft 420 rotates within cavity 432. Consequentially the longitudinal portion 428 angularly rotates in the orientation of arrow 434.

This angular, and hence reciprocal rotation and eccentric rotation of the tweezing element 410 causes the tweezing element 410 to elliptically rotate forming the substantially elliptical path 178 shown in FIG. 1B. The elliptical path 178 defines the lower section 180 thereof, which may be substantially tangent to a skin surface 184 (FIGS. 2A-2D), as was described hereinabove.

The tweezing element 410 defines a tweezing region 490 at an end portion 494 thereof, which is proximal to the skin surface 184. The tweezing region 490 may be defined as a region on the tweezing element 410 that is generally in contact with the hairs sometime during operation of the depilation device 400.

An edge 496 of the tweezing element 410 at end portion 494 may comprise any suitable breadth. In a non-limiting example the breadth may be in the range of approximately 2-10 mm. Additionally, in a non-limiting example the breadth of edge 496 may be in the range of approximately 2-8 mm. Additionally, in a non-limiting example the breadth of edge 496 may be in the range of approximately 2-6 mm. Additionally, in a non-limiting example the breadth of edge 496 may be in the range of approximately 2-4 mm. Additionally, in a non-limiting example the breadth of edge 496 may be in the range of less than 2 mm.

A depilation enclosure 498 is designed to enclose the tweezing region 490. The depilation enclosure 498 may be formed in any suitable manner. As seen in FIGS. 4A and 4B, an end portion 500 of the housing 402 forms the depilation enclosure 498.

The depilation enclosure 498 may comprise walls 502 with internal surfaces 504 spaced apart by a gap 506. The gap 506 may comprise any suitable breadth. In a non-limiting example the gap 506 may be in the range of approximately 2-10 mm. Additionally, in a non-limiting example the breadth of gap 506 may be in the range of approximately 2-8 mm. Additionally, in a non-limiting example the breadth of gap 506 may be in the range of approximately 2-6 mm. Additionally, in a non-limiting example the breadth of gap 506 may be in the range of approximately 2-4 mm. Additionally, in a non-limiting example the breadth of gap 506 may be in the range of less than 2 mm.

Clamping elements 510 may protrude from the depilation enclosure 498 towards the tweezing region 490. The clamping elements 510 may be formed in any suitable manner for clamping the tweezing members 484 together. As seen in FIGS. 4A and 4B the clamping elements 510 may comprise two oppositely facing balls 520 protruding from the depilation enclosure 498. The clamping elements 510 may comprise a single ball or a plurality of balls or any other suitable shape.

The balls 520 form theretween a gap 522 defining a clamping region 524. As the tweezing region 490 of the tweezing members 484 passes through the clamping region 524 the balls 520 press thereupon, thus forcing the tweezing members 484 to clamp together.

The clamping elements 510 may be designed for reduced friction thereof and of the tweezing members 484, due to cyclic passage of the tweezing members 484 through the clamping region 524. In a non-limiting example, balls 520 may be formed or coated with a material with a relatively low coefficient of friction, such as nylon which comprises a static coefficient of friction in the range of 0.15-0.25.

The clamping elements 510 may be formed of rotatable elements for reducing friction, as will be further described, such as in reference to FIGS. 5A-8D.

The depilation device 400 may be shaped in any suitable manner. In accordance with an embodiment, the housing 402 may be a hand-held device ergonomically formed with a longitudinal gripping portion 540 and a tapered portion 542 tapering towards the skin surface 184, as seen in FIG. 4B. Thus an operator of the depilation device 400 may comfortably grip the depilation device 400 at the gripping portion 540. The tapered portion 542 may be placed on the skin surface 184 for direct contact therewith.

During operation the operator may place the depilation device 400 upon the skin surface 184 substantially perpendicularly thereto in the orientation of axis 114. The operator may advance the depilation device 400 along the skin surface 184 in the orientation of axis 130 without removal of the depilation device 400 from above the skin surface 184, in the orientation of axis 114.

It is appreciated that the housing 402 may be alternatively shaped similar to housing 102 of depilation device 100 including the curved portion 242. The transmission assembly 412 and the tweezing element 410 may be formed so as to be inserted within the housing of depilation device 400.

Figure 5A:
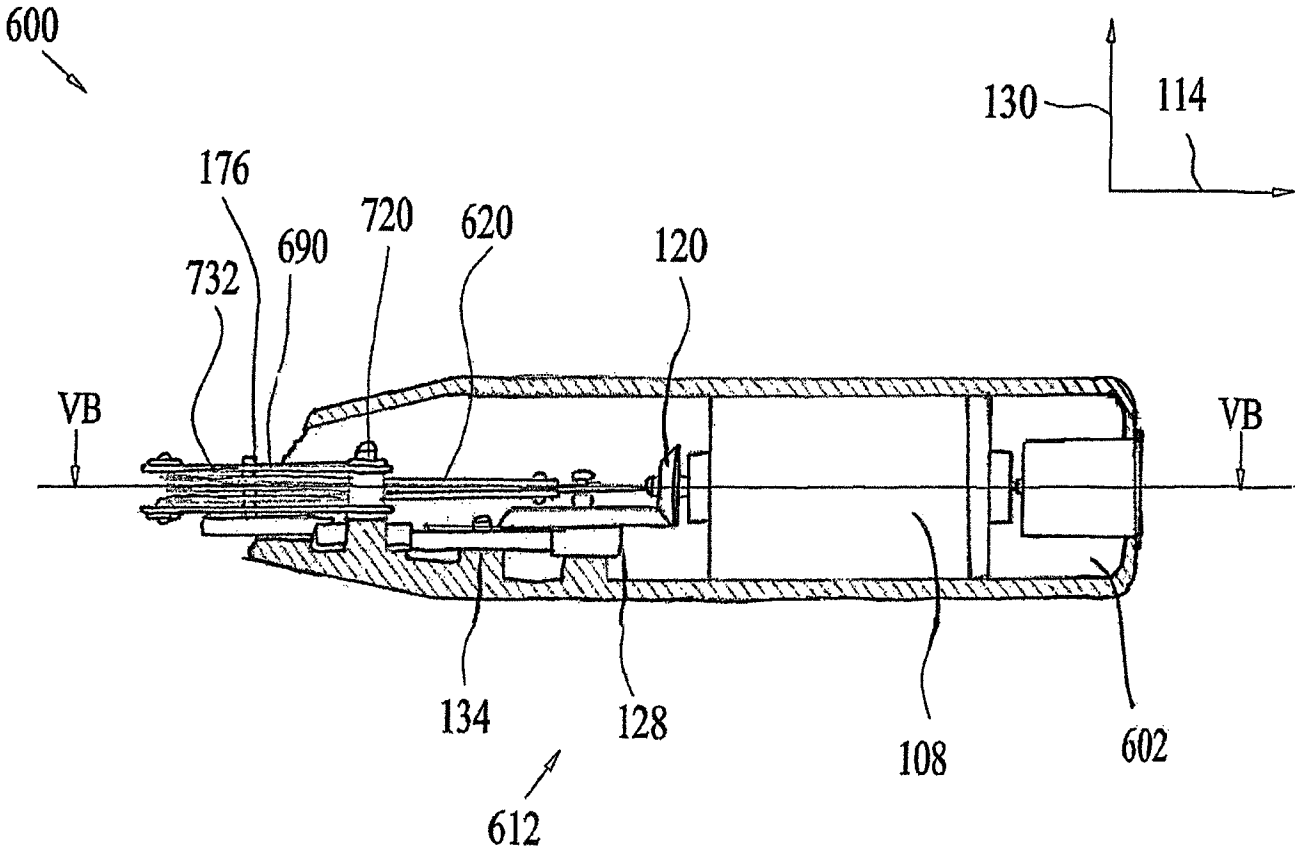
FIGS. 5A and 5B are a simplified partially sectional, partially cut-away illustration of a depilation device, constructed and operative in accordance with another embodiment of the present invention, and a simplified sectional illustration taken along lines VB-VB of FIG. 5A, respectively.
Figure 5B:
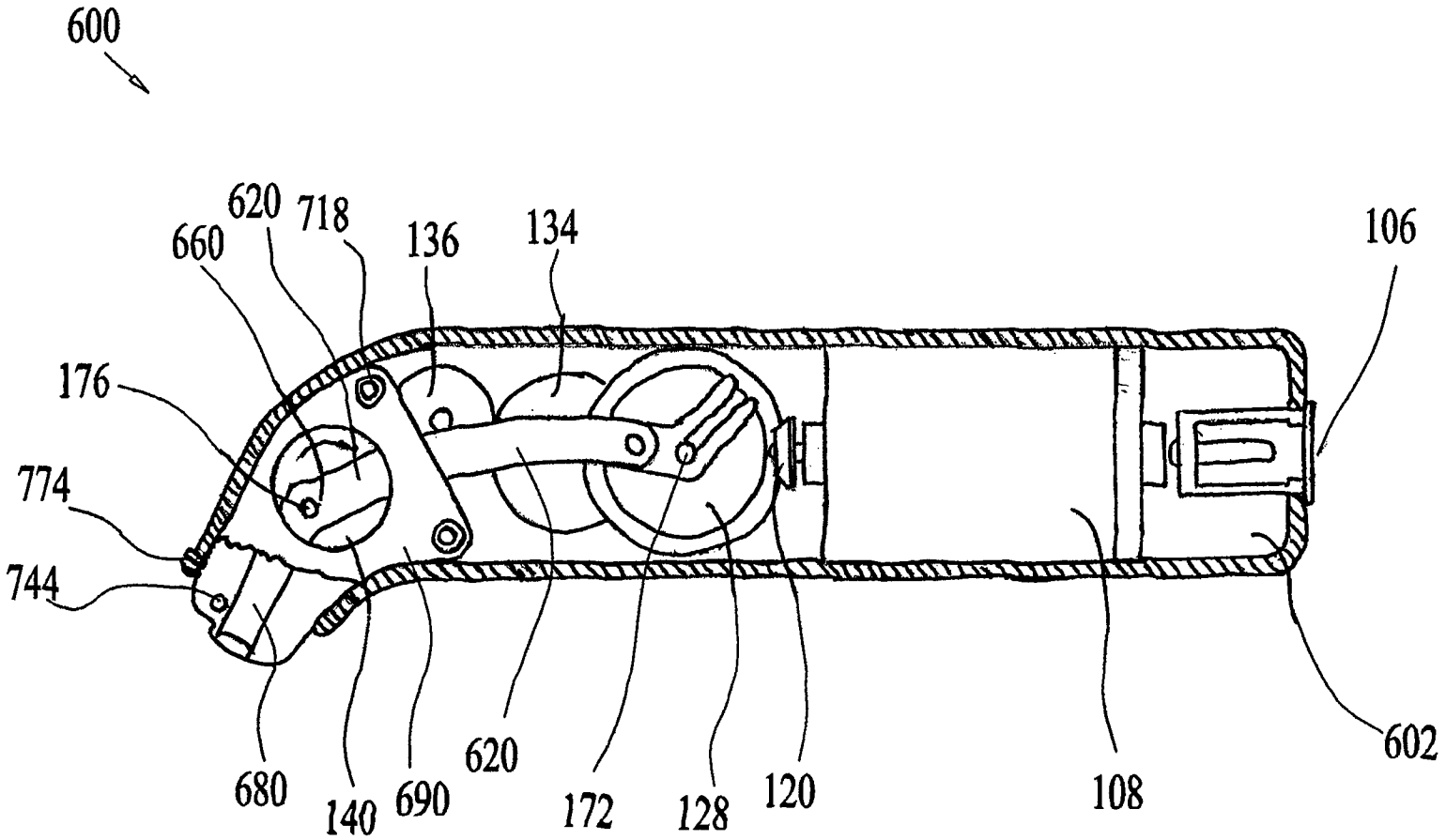
Figure 6A:
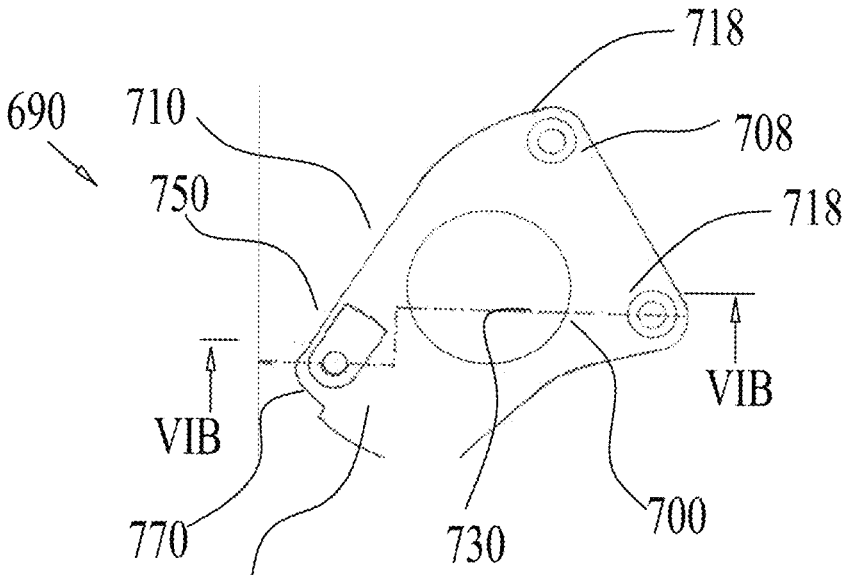
FIGS. 6A-6D is a simplified pictorial illustration of a depilation enclosure of the depilation device of FIGS. 5A and 5B, a simplified sectional illustration taken along lines VIB-VIB of FIG. 6A, a simplified top-view illustration of a tweezing element of the depilation device of FIGS. 5A and 5B, and a simplified side-view illustration of the tweezing element, respectively.
Figure 6B:
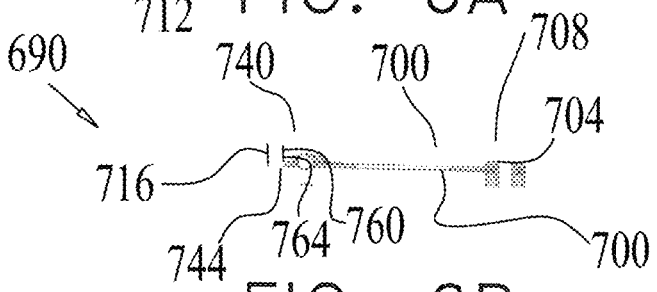

Reference is now made to FIGS. 5A-6D, which are a simplified, partially sectional, partially cut-away illustration of a depilation device, constructed and operative in accordance with another embodiment of the present invention, and a simplified sectional illustration taken along lines VB-VB of FIG. 5A, a simplified pictorial illustration of a depilation enclosure of the depilation device of FIGS. 5A and 5B, a simplified sectional illustration taken along lines VIB-VIB of FIG. 6A, a simplified top-view illustration of a tweezing element of the depilation device of FIGS. 5A and 5B, and a simplified side-view illustration of the tweezing element, respectively.

The depilation device 600 shown in FIGS. 5A and 5B may comprise a housing 602 and a transmission assembly 612 substantially similar to respective housing 102 and transmission assembly 112 of the depilation device 100 of FIGS. 1A-2D.

Figure 6C:
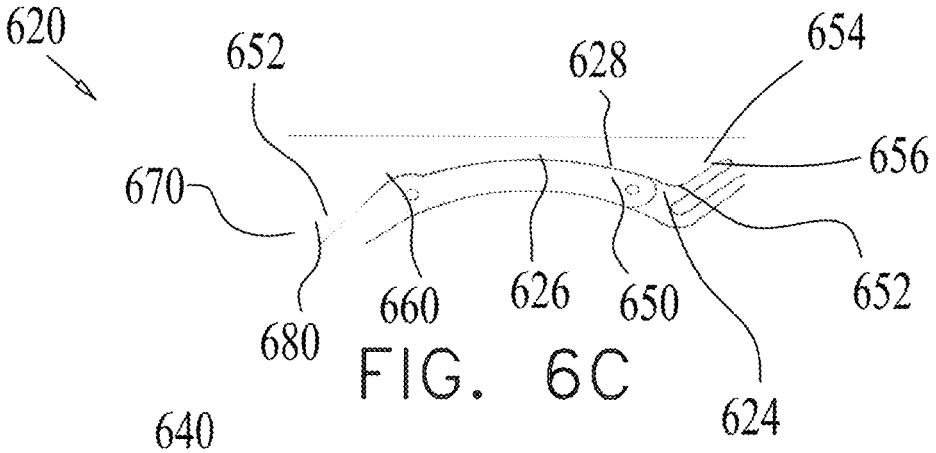
Figure 6D:
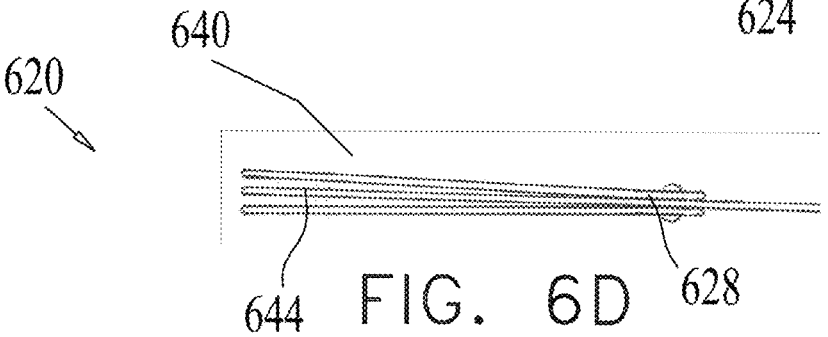

As seen in FIG. 6C, a tweezing element 620 may comprise a first section 624 fixed to a second section 626 via a joining pin 628 of the tweezing element 620.

The second section 626 may include three tweezing members 640 (FIG. 6D) each comprising a lever 644. The tweezing members 640 may be engaged therebetween in any suitable manner, such as by the joining pin 628.

The second section 626 may be shaped to arcuately extend from a first end portion 650 to a second end portion 652 thereof.

The tweezing element 620 may be shaped in any suitable manner to fit within the housing 602 of the depilation device 600.

The first section 624 may be formed with an elongated slot 654 which may be open at an end portion 656 thereof. The elongated slot 654 is provided for mounting the first section 624 on the second gear 128 via the central spindle 172, protruding from the second gear 128. The tweezing element 620 may be formed with an aperture 660 for inserting therein the eccentric spindle 176 protruding from the fifth gear 140, thereby mounting the tweezing element 620 in proximity to the second end portion 652 thereof on the fifth gear 140.

Upon rotation of the motor 108 and first gear 120 about longitudinal axis 114 the respective second, third, fourth and fifth gears 128, 134, 136 and 140 rotate about the vertical axis 130. In turn, the first section 624 of tweezing element 110 reciprocally moves within slot 654. The second section 626 eccentrically rotates with the eccentric spindle 176. This reciprocal movement and eccentric rotation of the respective first section 624 and second section 626 causes the tweezing element 620 to elliptically rotate forming a substantially elliptical path 178 shown in FIG. 1B. The elliptical path 178 defines the lower section 180 thereof, which may be substantially tangent to the skin surface 184 (FIGS. 2A-2D), thus maximizing the contact of an edge 670 with the skin surface 184. Thus relatively short hairs may ingress in between the tweezing members 640.

The edge 670 of the tweezing element 620 may comprise any suitable breadth. In a non-limiting example the breadth may be in the range of approximately 2-10 mm. Additionally, in a non-limiting example the breadth of edge 670 may be in the range of approximately 2-8 mm. Additionally, in a non-limiting example the breadth of edge 670 may be in the range of approximately 2-6 mm. Additionally, in a non-limiting example the breadth of edge 670 may be in the range of approximately 2-4 mm. Additionally, in a non-limiting example the breadth of edge 670 may be in the range of less than 2 mm.

The tweezing element 620 defines a tweezing region 680 at the second end portion 652 thereof, which is proximal to the skin surface 184 (FIGS. 2A-2D). The tweezing region 680 may be defined as a region on the tweezing element 620 that is generally in contact with the hairs sometime during operation of the depilation device 600.

A depilation enclosure 690 is designed to enclose the tweezing region 680. In the embodiment of FIGS. 5A-6D the depilation enclosure 690 may comprise two oppositely facing plates 700 extending from a base 704 (FIG. 6B) at a first end portion 708 thereof. As seen in FIG. 6A, the plates 700 may slightly taper from first end portion 708 along edges 710 to a second end portion 712. The plate 700 may be formed in any suitable manner for allowing the plate 700 to fit within the housing 602. The two plates 700 may be held together by a bracket (not shown) or any other suitable manner.

The plates 700 are spaced apart by a gap 716. The gap 716 may comprise any suitable breadth. In a non-limiting example the gap 716 may be in the range of approximately 2-10 mm. Additionally, in a non-limiting example the breadth of gap 716 may be in the range of approximately 2-8 mm. Additionally, in a non-limiting example the breadth of gap 716 may be in the range of approximately 2-6 mm. Additionally, in a non-limiting example the breadth of gap 716 may be in the range of approximately 2-4 mm. Additionally, in a non-limiting example the breadth of gap 716 may be in the range of less than 2 mm.

Two apertures 718 may be formed in base 704 for mounting the depilation enclosure 690 on two corresponding protrusions 720 protruding from housing 602. Each of the plates 700 may be formed with a generally central aperture 730.

The tweezing element 620 may be inserted in between plates 700 and mounted on the eccentric spindle 176 which protrudes upwardly from the aperture 730 of an upper plate 732 of plates 700.

The depilation enclosure 690 may comprise clamping elements 740 at the second end portion 712 overlaying the tweezing region 680 of the tweezing element 620. The clamping elements 740 may be formed in any suitable manner for clamping the tweezing members 640 together. As seen in FIGS. 5A-6B the clamping elements 740 may comprise two oppositely facing balls 744. Each ball 744 may be placed within a socket 750 (FIG. 6A) formed in the second end portion 712, thereby allowing the balls 744 to turn within the socket 750. The clamping elements 740 may comprise a single ball or a plurality of balls or any other suitable shape.

The balls 744 form theretween a gap 760 defining a clamping region 764. As the tweezing members 640 at the tweezing region 680 pass through the clamping region 764, the balls 744 press thereupon, thus forcing the tweezing members 640 to clamp together.

The clamping elements 740 may be designed for reduced friction thereof and of the tweezing members 640, due to cyclic passage of the tweezing members 640 through the clamping region 764. Each ball 744 may turn within the corresponding socket 750 when pressing on the tweezing members 640, thereby reducing the friction thereof and of the tweezing members 640.

At the second end portion 712 of the depilation enclosure 690 may be formed a tooth 770 provided for combing hairs on the skin surface 184 (FIGS. 2A-2D) so as to insert the hairs within gap 716 of the depilation enclosure 690.

An illumination apparatus, such as a light emitting diode (LED) 774 may be provided for illuminating the skin surface 184, thereby aiding the operator to see the hairs on the skin surface 184 for depilation thereof. It is appreciated that in all the embodiments of the depilation device disclosed in reference to FIGS. 1A-11 an illumination apparatus may be provided.

Figure 7A:
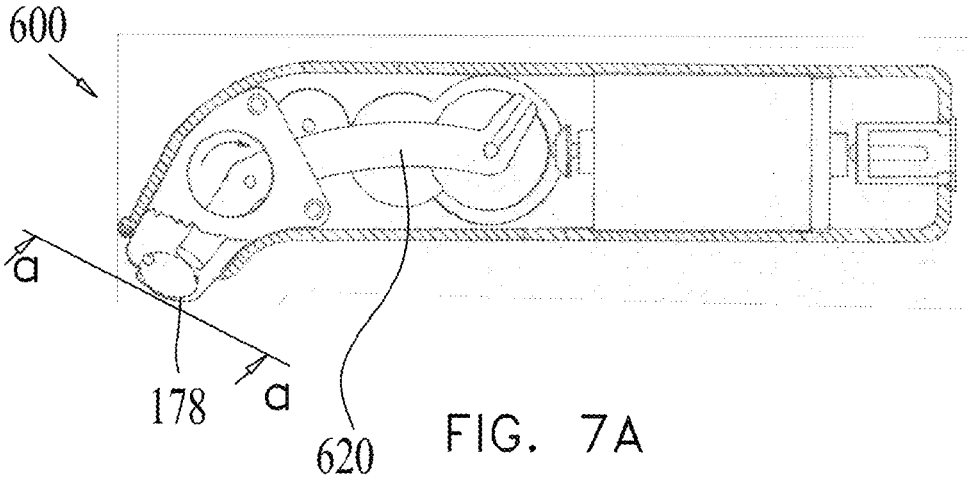

Reference is now made to FIGS. 7A-7D, which are simplified operational illustrations of the depilation device of FIGS. 5A-6D, shown in the orientation of FIG. 5B. As seen in FIG. 7A, at a first operational stage, an operator places the depilation device 600 on the skin surface 184 (FIG. 2A-2D). The tweezing element 620 is shown at point A of the substantially elliptical path 178. As seen in the sectional illustration taken along lines a-a in FIG. 7A, the tweezing members 640 are unclamped and away the clamping region 764. Hairs 280, 282 and 284 (FIG. 2A-2D) grow from the follicles 288 and protrude from the skin surface 184.

Figure 7B:
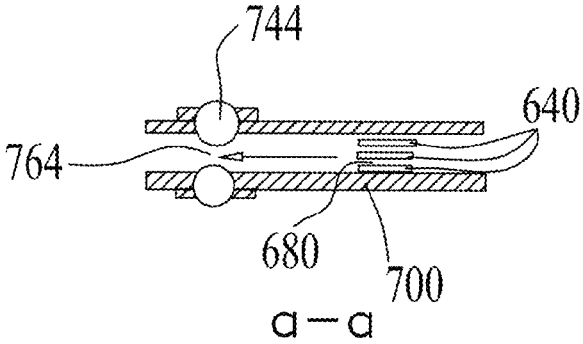
Figure 7B:
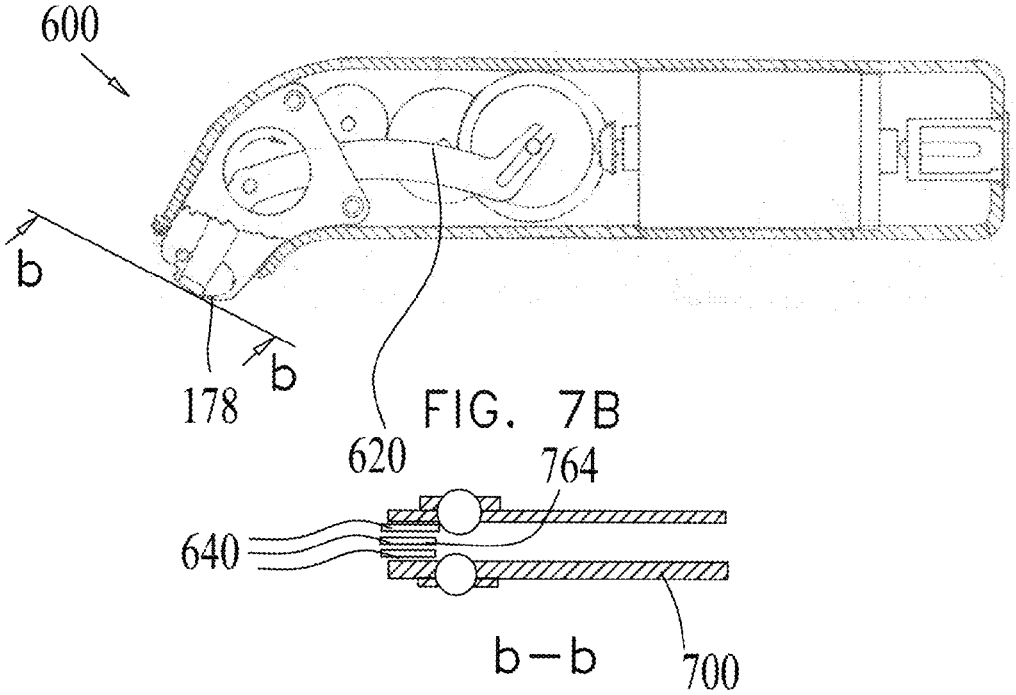

Turning to FIG. 7B at a second operational stage, the tweezing element 620 is shown at point B of the substantially elliptical path 178. As seen in the sectional illustration taken along lines b-b in FIG. 7B, the tweezing members 640 remain unclamped and may touch or nearly touch the skin surface 184. Thus hairs 280 and 282 ingress in between the tweezing members 640, at the tweezing region 680.

As described hereinabove, the lower section 180 of the elliptical path 178 may be substantially tangent to the skin surface 184, thus maximizing the contact of the edge 670 with the skin surface 184. Thus relatively short hairs, such as hair 280, may ingress in between the tweezing members 640.

As seen in FIG. 7C, at a third operational stage, the tweezing element 620 is shown at point C of the substantially elliptical path 178. As seen in the sectional illustration taken along lines c-c in FIG. 7C, the tweezing members 640 pass through the clamping region 764 formed intermediate the two balls 744. The two balls 744 force the tweezing members 640 to clamp to each other for tightly gripping hairs 280 and 282 at the tweezing region 680. Subsequently, the hairs 280 and 282 are plucked from their follicles 288, as the tweezing element 620 progresses from point B to C along path elliptical path 178 thereby pulling away from the skin surface 184.

Turning to FIG. 7D, at a fourth operational stage, the tweezing element 620 is shown at point D of the substantially elliptical path 178. As seen in the sectional illustration taken along lines d-d in FIG. 7D, the tweezing members 640 egress the clamping region 680. The tweezing members 640 unclamp, thereby releasing the hairs 280 and 282. The hairs 280 and 282 generally egress the depilation device 600.

Following removal of hairs 280 and 282, the operator may advance the depilation device 600 along the skin surface 184 in the orientation of arrow 290 so as to commence the operational stages 7A-7D for removal of further hairs, such as hair 284, without removal of the depilation device 600 from above the skin surface 184, as shown by an arrow 292. The arrow 292 is in a transverse orientation to arrow 290 and is perpendicular to the surface of the skin surface 184.

Figure 8A:
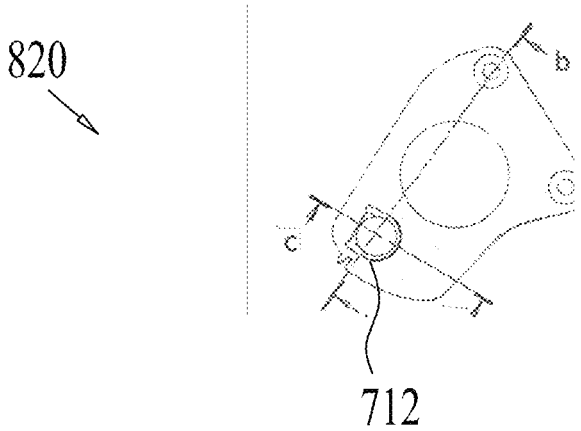
FIGS. 8A-8F is a simplified pictorial illustration of an alternative depilation enclosure of the depilation device of FIGS. 5A and 5B, a simplified sectional illustration taken along lines b-b of FIG. 8A, a simplified top-view illustration of a tweezing element of the depilation device of FIGS. 5A and 5B, a simplified side-view illustration of the tweezing element, a simplified sectional illustration taken along lines c-c of FIG. 8A at a first operational stage and a simplified sectional illustration taken along lines c-c of FIG. 8A at a second operational stage, respectively.

Reference is now made to FIGS. 8A-8F, which is a simplified pictorial illustration of an alternative depilation enclosure of the depilation device of FIGS. 5A and 5B, a simplified sectional illustration taken along lines b-b of FIG. 8A, a simplified top-view illustration of a tweezing element of the depilation device of FIGS. 5A and 5B, a simplified side-view illustration of the tweezing element, a simplified sectional illustration taken along lines c-c of FIG. 8A at a first operational stage and a simplified sectional illustration taken along lines c-c of FIG. 8A at a second operational stage, respectively.

A depilation enclosure 820 is substantially similar to the depilation enclosure 690 of the depilation device 600, yet clamping elements 830 are different from the clamping elements 740 of the depilation enclosure 690.

Figure 8B:
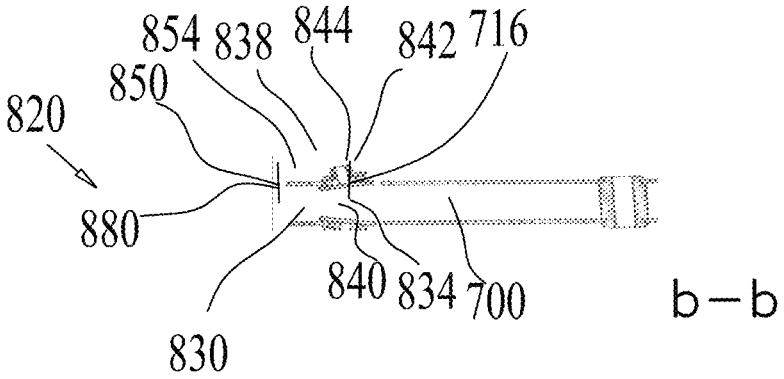
Figure 8C:
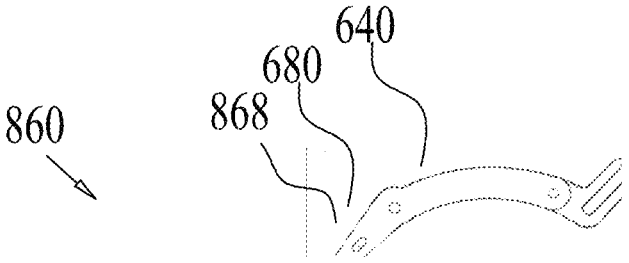
Figure 8D:
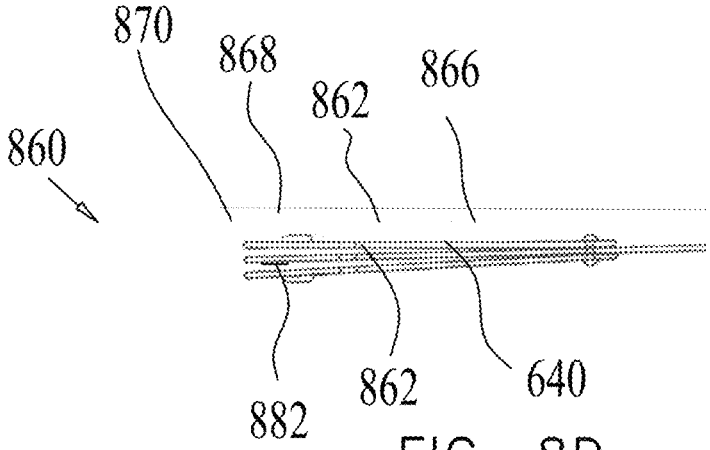

As seen in FIG. 8B, clamping elements 830 comprise two oppositely facing wheels 834, each wheel 834 turning about an axel 838. The wheels 834 may be supported by ball bearings 840. Each wheel 834 may be positioned to downwardly incline from an aperture 842 formed in plates 700, such that the gap 716 between first edges 844 of the wheels 834 is reduced to a gap 850 defined between second edges 854 of the wheels 834. The second edges 854 are proximal to the second end portion 712 of the depilation enclosure 820.

A tweezing element 860 is substantially similar to the tweezing element 620 of the depilation device 600 and comprises the three tweezing members 640 (FIG. 8D) including two external tweezing members 862. On an external surface 866 of each external tweezing member 862 protrudes a protrusion 868 placed in proximity to an end portion 870.

Figure 8E:
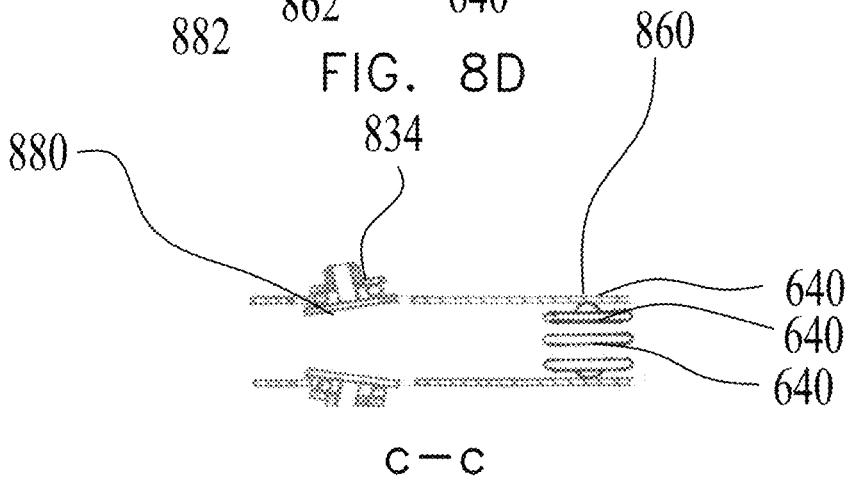
Figure 8F:
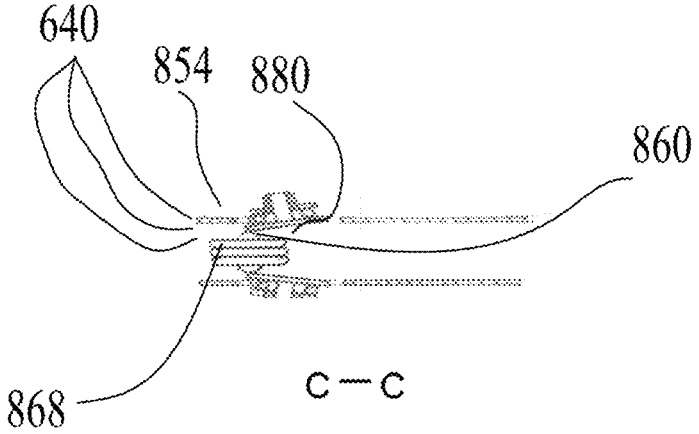

Gap 850 formed between the wheels 834 defines a clamping region 880. As the tweezing region 680 of the tweezing members 640 passes through the clamping region 880 the wheels 834 press upon the protrusions 868, thus forcing the tweezing members 640 to clamp together. This can be seen in FIG. 8E, showing the tweezing element 860 positioned away from the clamping region 880. In FIG. 8F the tweezing element 860 is shown to have moved forward within the clamping region 880. The protrusions 868 are pressed upon by the second edges 854 of the wheels 834.

In accordance with an embodiment, the protrusions 868 may be formed with an elongated length 882 spanning in the orientation of axis 114 (FIG. 1A) This elongates the duration the tweezing element 860 is positioned within the clamping region 880 and in turn elongated the duration the hairs are plucked from the skin surface 184, as described in the operation stage in reference to FIG. 7C.

The clamping elements 830 may be designed for reduced friction thereof and of the tweezing members 640, due to cyclic passage of the tweezing members 640 through the clamping region 880. Each of the wheels 834 may turn within the apratures 842 when pressing on the tweezing members 640, thereby reducing the friction thereof and of the tweezing members 640.

In accordance with an embodiment the depilation enclosure 820 may be configured to be removed from the depilation device 600 for cleaning of depilated hairs within and reattaching the depilation enclosure 820 for further operation of the depilation device 600. The housing 602 may be formed with a removable cover for allowing removal of the depilation enclosure 820.

Figure 9A:
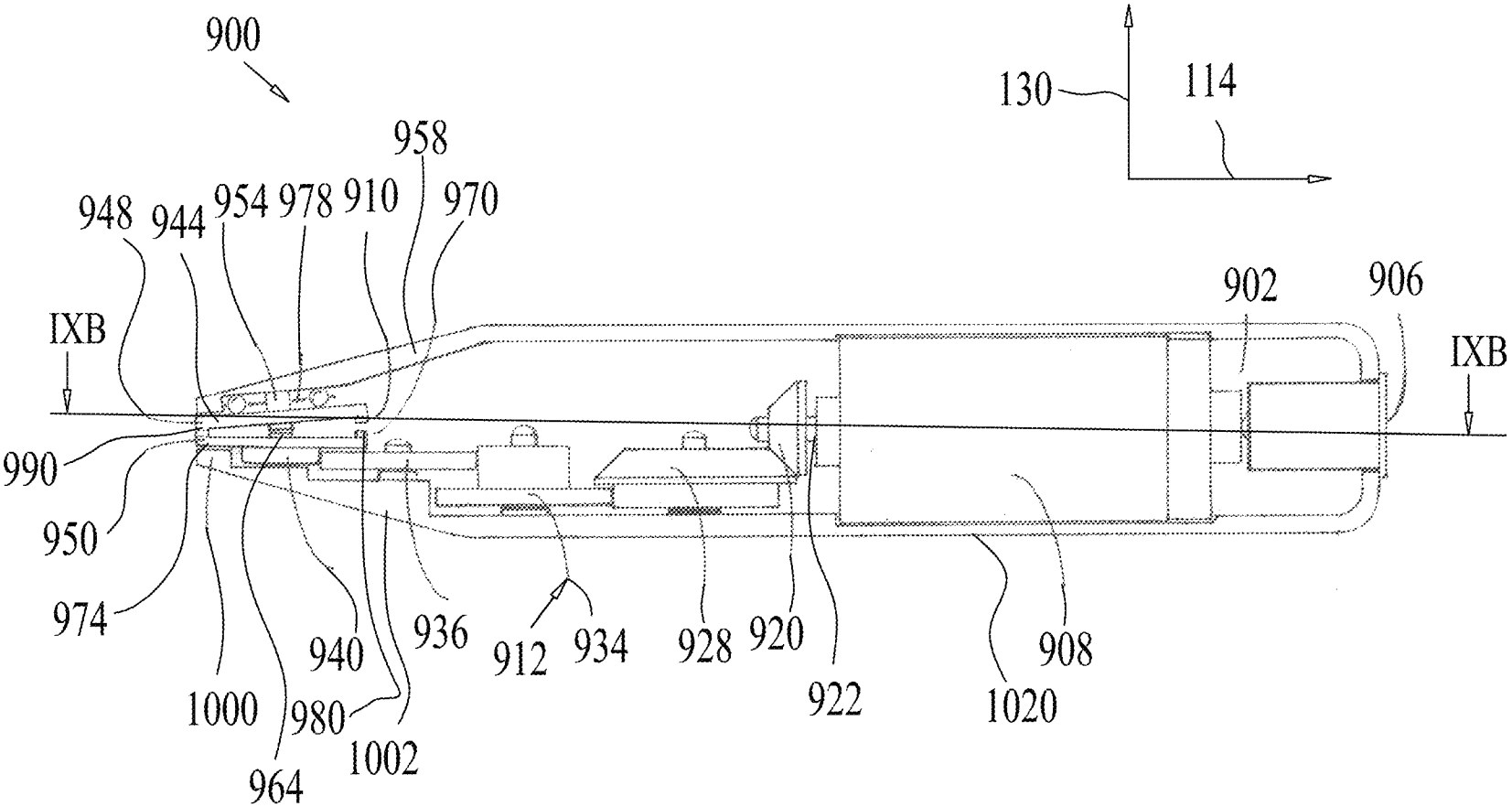
FIGS. 9A and 9B are a simplified sectional illustration of a depilation device, constructed and operative in accordance with another embodiment of the present invention, and a simplified sectional illustration taken along lines IXB-IXB of FIG. 9A, respectively.
Figure 9B:
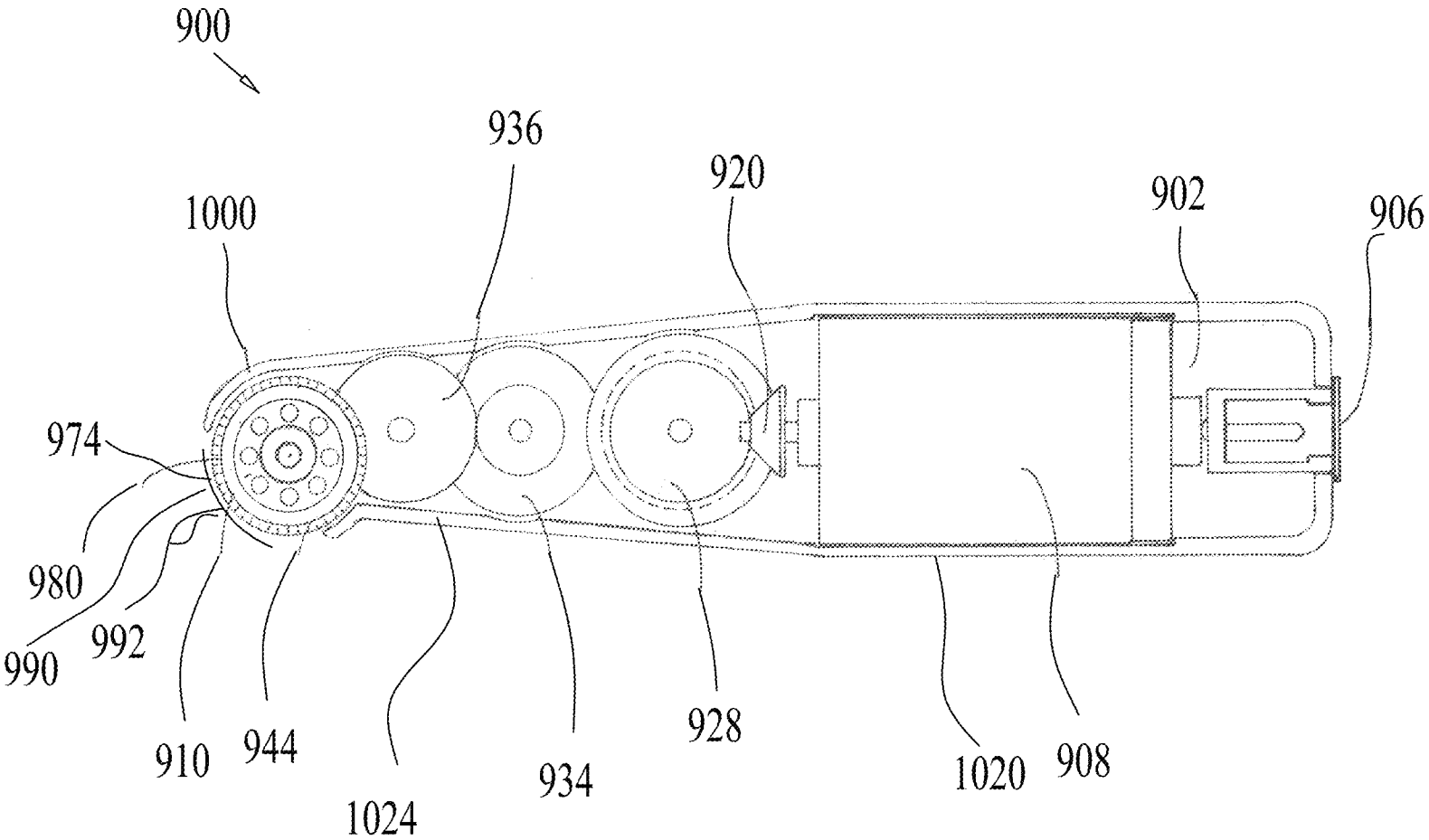

Reference is now made to FIGS. 9A and 9B, which is a simplified sectional illustration of a depilation device, constructed and operative in accordance with an embodiment of the present invention, and a simplified sectional illustration taken along lines IXB-IXB of FIG. 9A, respectively. As seen in FIG. 9A, a depilation device 900 comprises a housing 902. A socket 906 connected via an outlet to a power supply, is provided to activate a motor 908. Alternatively, the power supply may be provided by batteries. The socket 906 may be designed with appropriate attachments allowing the batteries to be recharged.

The motor 908 is provided to move a tweezing element 910 via a transmission assembly 912. The motor 908 rotates about the longitudinal axis 114. The transmission assembly 912 may comprise a first gear 920, such as a bevel gear, inserted on a drive shaft 922 protruding from the motor 908. The first gear 920 rotates about the longitudinal axis 114. The first gear 920 contacts a second gear 928 thereby translating the first gear 920 rotation about longitudinal axis 114 to rotate about a vertical axis 130 in the plane shown in FIG. 9A. The rotation of second gear 928 is transmitted via a third gear 934 and a fourth gear 936 to a fifth gear 940. The transmission assembly 912 may be designed with any suitable number of gears for transmitting movement from the motor 908 to the tweezing element 910 and may be substantially similar to the transmission assembly 112 of FIGS. 1A and 1B.

The tweezing element 910 may be configured in any suitable configuration. The tweezing element 910 generally may be formed with at least two tweezing members 944. In the embodiments shown in FIGS. 9A and 9B the tweezing element 910 may be formed of two tweezing members 944 comprising an upper disc 948 and a lower disc 950.

It is noted that tweezing element 910 may be formed with additional tweezing members 944, such as three or four discs, for example.

The upper disc 948 may be mounted on an upper spindle 954 protruding from a wall 958 of housing 902. The lower disc 950 may be mounted on a lower spindle 964 protruding from the fifth gear 940.

The upper spindle 954 and lower spindle 964 may be slightly inclined, thereby separating the upper disc 948 from the lower disc 950 at a first end portion 970 of the tweezing element 910. At a second end portion 974 of the tweezing element 910 the upper disc 948 is attached to the lower disc 950.

A ball bearing 978 may be provided intermediate the upper disc 948 and the housing 902 or any suitable means for reducing friction of the tweezing element 910.

In accordance with one embodiment, the upper disc 948 and the lower disc 950 may each be formed with peripheral teeth 980. The peripheral teeth 980 of the upper disc 948 may interlock with the peripheral teeth 980 of the upper disc 948 at the second end portion 974.

The tweezing element 910 defines a tweezing region 990 at the second end portion 974 thereof. The tweezing region may be defined as a region on the tweezing element 910 that is generally in contact with the hairs sometime during operation of the depilation device 900. As seen in FIG. 9B, the tweezing region 990 may include an arcuate portion 992 of the tweezing members 944. The hairs are inserted in between small gaps formed between the interlocked teeth 980 along the arcuate portion 992. The arcuate portion 992 is substantially tangent to the skin surface 184 when placed thereupon. Tangency to the skin surface 184 maximizes the contact of the second end portion 974 with the skin surface 184. Thus relatively short hairs, such as hair 280 (FIGS. 2A-2D), may ingress in between small gaps formed in between the peripheral teeth 980 of the upper disc 948 and the lower disc 950.

Upon rotation of the motor 908 and first gear 920 about longitudinal axis 114 the respective second, third, fourth and fifth gears 928, 934, 136 and 940 rotate about the vertical axis 130. In turn, the tweezing element 910 rotates about the lower spindle 964 of the fifth gear 940.

During operation an operator places the depilation device 900 on the skin surface 184. The tweezing region 990 may be initially away from the skin surface 184 and the first end portion 970 faces the skin surface.

The transmission assembly 912 turns the tweezing element about vertical axis 130, approximately 180°, to a position, as seen in FIG. 9A, wherein the second end portion 974 faces the skin surface 184. The tweezing region 990 touches or nearly touches the skin surface 184. Thus hairs 280 and 282 (FIGS. 2A-2D) ingress in between the teeth 980 of the tweezing region 990.

After another approximately 180° rotation of the tweezing element 910, the tweezing region 990 once again faces away from the skin surface 184. Subsequently, the hairs 280 and 282 are plucked from their follicles 288, as the tweezing region 990 rotates away from the skin surface 184, thereby pulling away from the skin surface 184.

The hairs 280 and 282 generally egress the depilation device 900.

Following removal of hairs 280 and 282, the operator may advance the depilation device 900 along the skin surface 184 in the orientation of arrow 290 (FIG. 2D) so as to remove of further hairs, without removal of the depilation device 900 from above the skin surface 184, as shown by the arrow 292.

It is thus seen from FIGS. 9A and 9B, the hairs are inserted in between small gaps formed between the interlocked teeth 980 along the arcuate portion 992 and are subsequently plucked. Thus the depilation device 900 is suitable for plucking hairs from the small selected area 256 (FIG. 1C).

A depilation enclosure 1000 is designed to enclose the tweezing region 990. The depilation enclosure 1000 may be formed in any suitable manner. As seen in FIGS. 9A and 9B, an end portion 1002 of the housing 902 forms the depilation enclosure 1000.

The depilation device 900 may be shaped in any suitable manner. In accordance with an embodiment, the housing 902 may be a hand-held device ergonomically formed with a longitudinal gripping portion 1020 and a tapered, curved portion 1024 curving towards the skin surface 184, as seen in FIG. 9B. Thus an operator of the depilation device 900 may comfortably grip the depilation device 900 at the gripping portion 1020. The curved portion 1024 may be placed on the skin surface 184 for direct contact therewith.

Employment of the depilation device 900 by the operator 250 is substantially similar to the operation described in reference to FIG. 1C, mutatis mutandis.

Figure 10A:
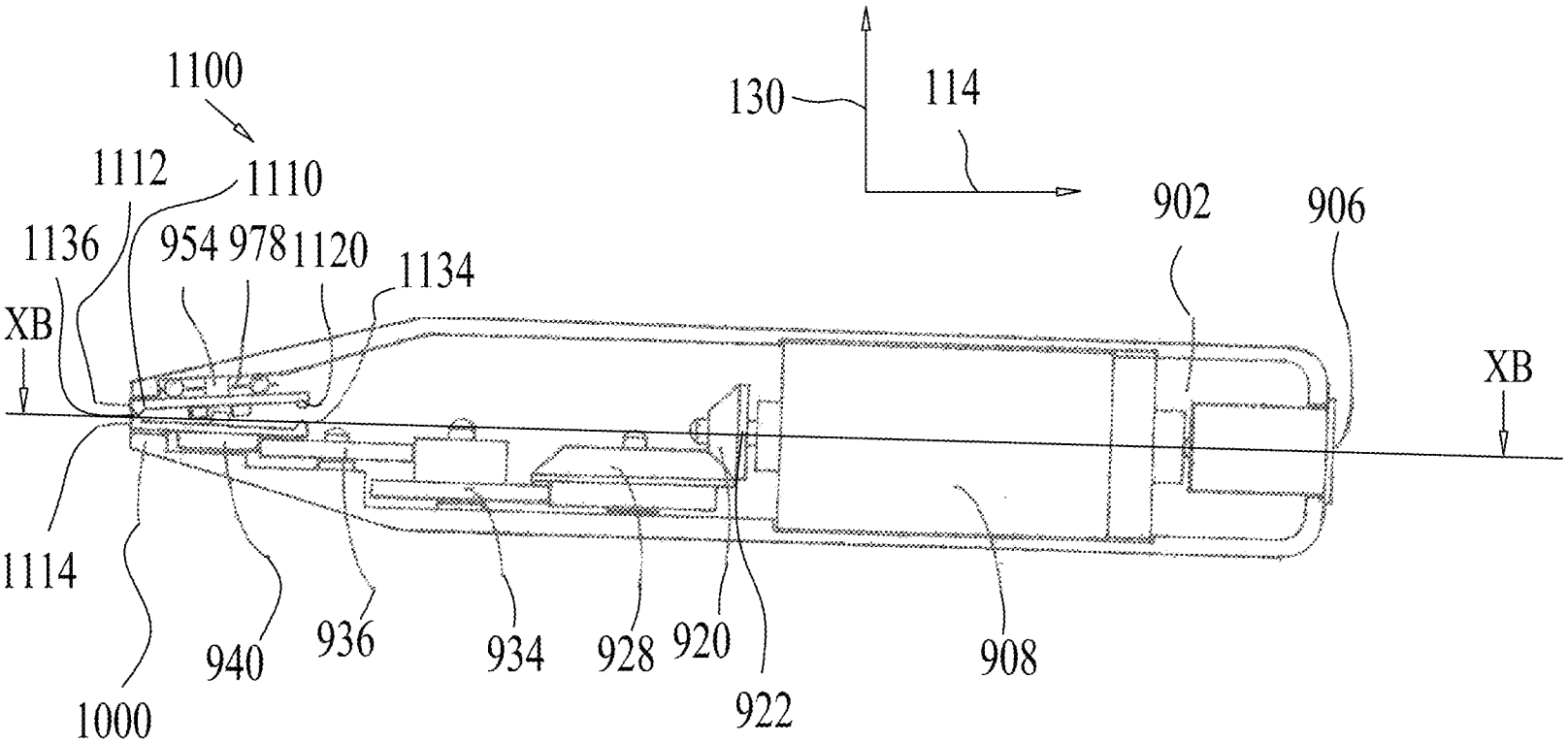
FIGS. 10A and 10B are a simplified sectional illustration of a depilation device, constructed and operative in accordance with another embodiment of the present invention, and a simplified sectional illustration taken along lines XB-XB of FIG. 10A, respectively.
Figure 10B:
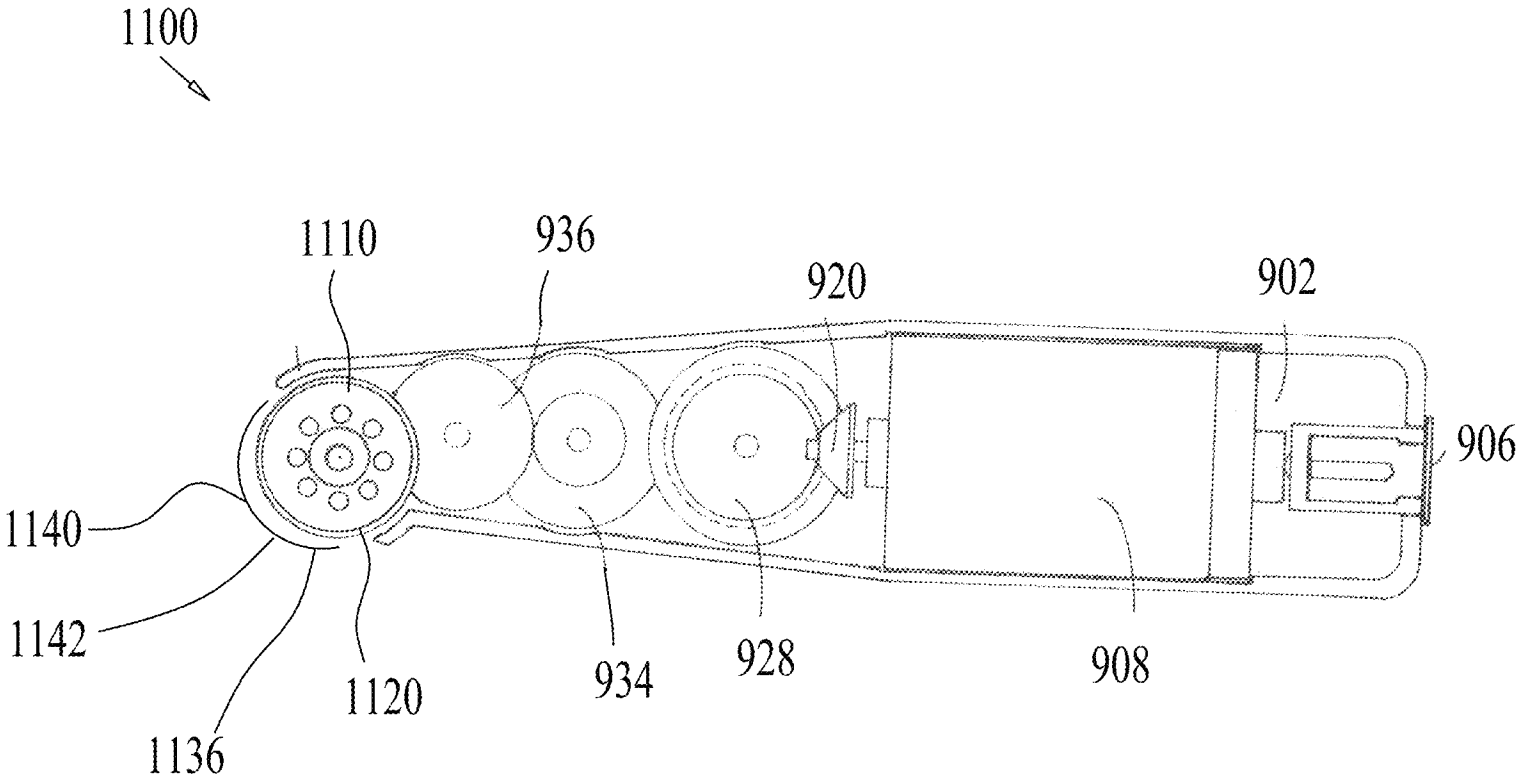
Figure 11:
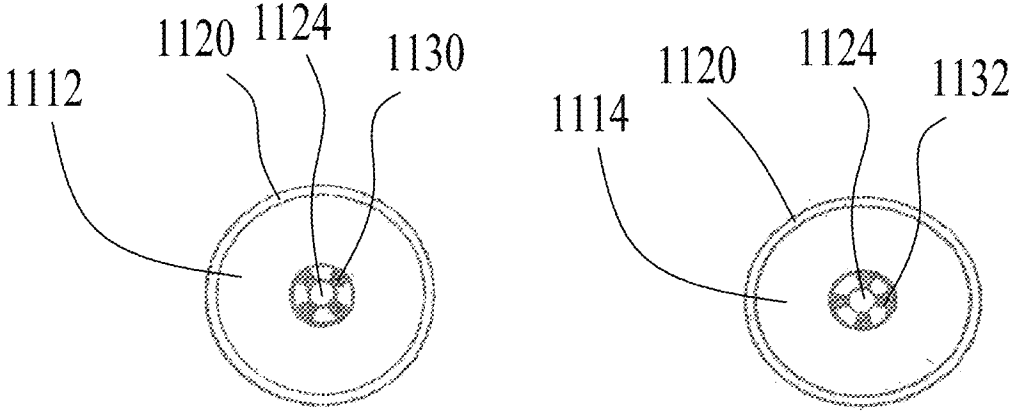
FIG. 11 is a simplified pictorial illustration of tweezing members of FIGS. 10A and 10B.

Reference is now made to FIGS. 10A, 10B and 11, which are a simplified sectional illustration of a depilation device, constructed and operative in accordance with an embodiment of the present invention, and a simplified sectional illustration taken along lines XB-XB of FIG. 10A, and a simplified pictorial illustration of the tweezing members of FIGS. 10A and 10B, respectively.

As seen in FIGS. 10A-11 the depilation device 1100 is substantially similar to the depletion device 900 of FIGS. 9A and 9B. In the depilation device 1100 a tweezing element 1110 is formed of tweezing members comprising an upper disc 1112 and a lower disc 1114. The upper disc 1112 and lower disc 1114 are each formed with a peripheral rim 1120 and a central hub 1124. A plurality of annular lobes 1130 project from hub 1124 of the upper disc 1112 and a plurality of annular lobes 1132 project from hub 1124 of the lower disc 1114, as seen in FIG. 11. The lobes 1130 are positioned offset the lobes 1132 so as to interlock therewith, and may operate similarly to the functionality of a straight bevel gear.

The rims 1120 of the upper disc 1112 and the lower disc 1114 are spaced away from each other at a first end portion thereof 1134. The rims 1120 of the upper disc 1112 and the lower disc 1114 are engaged thereto at a second end portion 1136.

The tweezing element 1110 defines a tweezing region 1140 at the second end portion 1136 thereof. The tweezing region may be defined as a region on the tweezing element 1110 that is generally in contact with the hairs sometime during operation of the depilation device 1100. As seen in FIG. 10B, the tweezing region 1140 may include an arcuate portion 1142 of the tweezing members. The hairs are inserted in between small gaps formed between the engaged rim 1120 along the arcuate portion 1142. The arcuate portion 1142 is substantially tangent to the skin surface 184 when placed thereupon. Tangency to the skin surface 184 maximizes the contact of the second end portion 1136 with the skin surface 184. Thus relatively short hairs, such as hair 280 (FIGS. 2A-2D), may ingress in between small gaps formed in between the peripheral rim 1120 of the upper disc 1112 and the lower disc 1114.

Upon rotation of the motor 908 and first gear 920 about longitudinal axis 114 the respective second, third, fourth and fifth gears 928, 934, 936 and 940 rotate about the vertical axis 130. In turn, the tweezing element 1110 rotates.

During operation an operator places the depilation device 1110 on the skin surface 184. The tweezing region 1140 may be initially away from the skin surface 184 and the first end portion 1134 faces the skin surface.

The transmission assembly 912 turns the tweezing element about vertical axis 130, approximately 180°, to a position, as seen in FIG. 10A, wherein the second end portion 1136 faces the skin surface 184. The tweezing region 1140 touches or nearly touches the skin surface 184. Thus hairs 280 and 282 (FIGS. 2A-2D) ingress in between the engaged rims 1120 of the tweezing region 1140.

After another approximately 180° rotation of the tweezing element 1110, the tweezing region 1140 once again faces away from the skin surface 184. Subsequently, the hairs 280 and 282 are plucked from their follicles 288, as the tweezing region 1140 rotates away from the skin surface 184, thereby pulling away from the skin surface 184.

The hairs 280 and 282 generally egress the depilation device 1100.

Following removal of hairs 280 and 282, the operator may advance the depilation device 1100 along the skin surface 184 in the orientation of arrow 290 (FIG. 2D) so as to remove of further hairs, without removal of the depilation device 1100 from above the skin surface 184, as shown by the arrow 292.

It is thus seen from FIGS. 10A and 10B, the hairs are inserted in between small gaps formed between the engaged rims 1120 along the arcuate portion 1142 and are subsequently plucked. Thus the depilation device 1100 is suitable for plucking hairs from the small selected area 256 (FIG. 1C).

The operation of the depilation device 1100 is substantially similar to the operation of the depilation device 900, mutatis mutandis.

It is noted that the upper disc 1112 and lower disc 1114 may be switched wherein the upper disc 1112 may be mounted on the lower spindle 964.

In accordance with an embodiment any one of the depilation devices described hereinabove may be configured with a removable portion comprising the tweezing region for allowing cleaning of depilated hairs inadvertently remaining within the depilation device. For example, the depilation enclosure 690 of FIGS. 5A-6D may be configured to be removed from the depilation device 600 for cleaning of depilated hairs within and reattaching the depilation enclosure 690 for further operation of the depilation device 600.

It will be appreciated by persons skilled in the art that the present invention is not limited by what has been particularly shown and described herein above. Rather the scope of the present invention includes both combinations and subcombinations of the various features described hereinabove as well as variations and modifications which would occur to persons skilled in the art upon reading the specifications and which are not in the prior art.

The invention claimed is:

1. A depilation device for tweezing hairs of a selected area of a skin surface, comprising:

a motor;

a tweezing element formed with at least two tweezing members, said tweezing element comprising a tweezing region at an end portion thereof configured to be placed proximal to said skin surface, said tweezing region defining a region on said tweezing element that is in contact with hairs sometime during operation of said depilation device;

a transmission assembly configured to transmit movement of said motor to said tweezing element; and a depilation enclosure configured to enclose at least said tweezing region and comprising an opening configured to be placed on said selected area;

said selected area being defined by a breadth and length, wherein said breadth is relatively narrow;

said depilation enclosure being configured substantially without any components peripheral to said depilation device, which components would disable an operator to view, during operation of said depilation device, an area adjacent to said breadth of said selected area; wherein each of said at least two tweezing members is configured to move in an elliptical path that includes a lower section substantially tangent to the skin surface, the elliptical paths being on distinct planes from each other; and said tweezing element is configured to depilate hairs while said depilation enclosure is configured to be generally continuously in contact with said skin surface and while each of said tweezing members encloses its respective elliptical path, thereby allowing continuous depilation along said length of said selected area without necessitating removal of said depilation device above said skin surface.

2. A depilation device according to claim 1, wherein said tweezing element is configured not to pass said opening of said depilation enclosure during operation of said depilation device.

3. A depilation device according to claim 1, wherein said depilation enclosure comprises a clamping element configured to clamp together said tweezing members at said tweezing region thereby gripping hairs for depilation thereof.

4. A depilation device according to claim 1, wherein a portion of a housing of said depilation device comprises said depilation enclosure.

5. A depilation device according to claim 1, wherein said depilation enclosure comprises one of two parallel plates and a comb comprising one of a tooth and a recess.

6. A depilation device according to claim 1 wherein a housing of the depilation device comprises a longitudinal portion and a curved or tapered portion, said curved or tapered portion comprises the depilation enclosure.

7. The depilation device according to claim 1, wherein a lower section of said elliptical path is configured to be substantially tangential to said skin surface.

8. A depilation device according to claim 1, wherein said tweezing element is moved by said transmission assembly in a reciprocal movement and in an eccentric rotation.

9. A depilation device according to claim 1 wherein the transmission assembly comprises a supporting shaft for rotating about the motor and for supporting a bracket wherein the tweezing element is inserted in the bracket.

10. A depilation device according to claim 1 wherein the tweezing element comprises a first longitudinal portion and a second portion curved relative to the first longitudinal portion, the second portion comprises the tweezing region.

11. A depilation device according to claim 1 wherein each tweezing member comprises a disc.

12. A depilation device according to claim 1 wherein the tweezing element comprises at least two discs interlocked therebetween so as to mutually engage the discs at an end portion of the tweezing element and defining at the end portion the tweezing region, said interlocking by one of peripheral teeth formed on a periphery of each of the at least two discs and central lobes formed at a center of each of the at least two discs.

13. A method for tweezing hairs of a selected area of a skin surface, comprising:

providing a depilation device, said depilation device comprises:

a motor;

a tweezing element formed with at least two tweezing members, said tweezing element comprising a tweezing region at an end portion thereof configured to be placed proximal to said skin surface, wherein each of said at least two tweezing members is configured to move in an elliptical path that includes a lower section substantially tangent to the skin surface, the elliptical paths being on distinct planes from each other;

said tweezing region defining a region on said tweezing element that is in contact with hairs sometime during operation of said depilation device;

a transmission assembly configured to transmit movement of said motor to said tweezing element; and a depilation enclosure configured to enclose at least said tweezing region and comprising an opening configured to be placed on said selected area;

placing said opening of said depilation enclosure on said selected area, said selected area being defined by a breadth and length, wherein said breadth is relatively narrow;

transmitting movement of said motor to said tweezing element via said transmission assembly for depilation of said hairs by said tweezing element while each of said tweezing members encloses its respective elliptical path; and allowing an operator to view, during operation of said depilation device, an area adjacent to said breadth of the selected area.

* * * * *